US011319660B2

(12) United States Patent
Kim et al.

(10) Patent No.: US 11,319,660 B2
(45) Date of Patent: May 3, 2022

(54) CLOTHES HANDLING APPARATUS

(71) Applicant: SAMSUNG ELECTRONICS CO., LTD., Suwon-si (KR)

(72) Inventors: Joon Ho Kim, Suwon-si (KR); Jae Won Park, Suwon-si (KR); Hyun Su Kang, Seoul (KR); Ki Su Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 170 days.

(21) Appl. No.: 16/682,598

(22) Filed: Nov. 13, 2019

(65) Prior Publication Data

US 2020/0149212 A1 May 14, 2020

(30) Foreign Application Priority Data

Nov. 13, 2018 (KR) ..... 10-2018-0139308

(51) Int. Cl.
*D06F 39/14* (2006.01)
*D06F 37/42* (2006.01)

(52) U.S. Cl.
CPC ..... *D06F 39/14* (2013.01); *D06F 37/42* (2013.01)

(58) Field of Classification Search
CPC ..... D06F 39/14; D06F 37/42; D06F 2224/00
USPC ..... 68/12.26
See application file for complete search history.

(56) References Cited

U.S. PATENT DOCUMENTS

2006/0123855 A1* 6/2006 Erickson ..... D06F 39/14 68/24
2012/0292924 A1 11/2012 Promutico et al.

FOREIGN PATENT DOCUMENTS

| | | | |
|---|---|---|---|
| DE | 10 2009 044 126 | B3 | 11/2010 |
| EP | 3 323 930 | A1 | 5/2018 |
| JP | 2007-195859 | A | 8/2007 |
| JP | 2009-95530 | A | 5/2009 |
| JP | 2016-158733 | A | 9/2016 |
| KR | 10-2012-0008689 | A | 2/2012 |
| KR | 10-2015-0131532 | A | 11/2015 |
| KR | 10-1565381 | | 11/2015 |
| KR | 10-2017-0097410 | | 8/2017 |
| KR | 10-1772971 | | 9/2017 |
| KR | 10-2018-0007696 | A | 1/2018 |
| WO | WO 2014/161784 | A1 | 10/2014 |

(Continued)

OTHER PUBLICATIONS

KR20150131532A—Machine translation (Year: 2015).*

(Continued)

*Primary Examiner* — Tinsae B Ayalew
(74) *Attorney, Agent, or Firm* — Staas & Halsey LLP

(57) ABSTRACT

Disclosed herein is a clothes handling apparatus that allows a user to easily change a door opening direction. The clothes handling apparatus includes a cabinet having an opening formed in a front surface thereof, a door configured to open or close the opening, and a door lock including a first door latch installed at a right side of the opening and provided to lock the door and a second door latch installed at a left side of the opening and provided to lock the door. The door may be rotatably installed at the left side of the opening or rotatably installed at the right side of the opening, and the first door latch or the second door latch may lock the door depending on whether the door is installed at the left side or the right side of the opening.

14 Claims, 24 Drawing Sheets

(56) References Cited

FOREIGN PATENT DOCUMENTS

| | | |
|---|---|---|
| WO | WO 2015/121772 A1 | 8/2015 |
| WO | WO 2015/130247 A1 | 9/2015 |

OTHER PUBLICATIONS

JP2016158733A—Machine translation (Year: 2016).*
International Search Report dated Mar. 18, 2020, in corresponding International Patent Application No. PCT/KR2019/015448.
Extended European Search Report dated Sep. 30, 2021, in European Application No. 19883679.3.

* cited by examiner

CLOTHES HANDLING APPARATUS

CROSS-REFERENCE TO RELATED APPLICATION

This application claims the benefit of Korean Patent Application No. 10-2018-0139308, filed on Nov. 13, 2018 in the Korean Intellectual Property Office, the disclosure of which is incorporated herein by reference.

BACKGROUND

1. Field

The present disclosure relates to a clothes handling apparatus, and more particularly, to a clothes handling apparatus that allows a user to easily change a door opening direction (left hand opening or right hand opening).

2. Description of the Related Art

Generally, a clothes handling apparatus may include a washer which washes clothes and a dryer which dries the clothes.

The washer may include a rotatable drum and remove contaminants (foreign substances) attached to clothes by using a mechanical action by rotation of the drum and a chemical action by a detergent. The washer may be a front loading type in which an opening for putting laundry (load) in the drum is provided at a front surface of a main body of the washer or may be a top loading type in which the opening is provided at an upper surface of the main body of the washer.

The dryer may also include a rotatable drum and remove moisture from clothes using a mechanical action by rotation of the drum and a high-temperature dry hot air. Nowadays, most dryers are a front loading type in which an opening for putting laundry (load) in the drum is provided at a front surface of a main body of the dryer.

A user may use a front-loading type washer and a front-loading type dryer together.

In this case, for convenience of the user, a door opening direction of the washer and a door opening direction of the dryer may be different. For example, when the washer is disposed at the left side of the dryer and the dryer is disposed at the right side of the washer, the washer may include a left hand opening door which opens from the left side, and the dryer may include a right hand opening door which opens from the right side.

Generally, a washer and a dryer each include a left hand opening door which opens from the left side. Therefore, for convenience of a user, a left hand opening door of any one of a washer and a dryer may be changed to a right hand opening door which opens from the right side.

In the conventional washer and dryer, since a front panel of a main body has to be removed to change a left hand opening door to a right hand opening door, it is difficult for a user to change a door opening direction by himself or herself.

SUMMARY

Therefore, it is an aspect of the present disclosure to provide a clothes handling apparatus that allows a user to easily change a door opening direction.

It is an aspect of the present disclosure to provide a clothes handling apparatus that allows a user to change a door opening direction without removing a front panel of a main body.

It is an aspect of the present disclosure to provide a clothes handling apparatus that allows a door to be locked even when a user changes an opening direction of the door.

It is an aspect of the present disclosure to provide a clothes handling apparatus that includes a pair of door locking devices installed at both sides of an opening for putting clothes in a drum.

It is an aspect of the present disclosure to provide a clothes handling apparatus in which a pair of door locking devices are formed to be symmetrical to each other.

Additional aspects of the disclosure will be set forth in part in the description which follows and, in part, will be obvious from the description, or may be learned by practice of the disclosure.

In accordance with one aspect of the present disclosure, a clothes handling apparatus includes a cabinet having an opening formed in a front surface thereof, a door configured to open or close the opening, and a door lock including a first door latch installed at a right side of the opening and provided to lock the door and a second door latch installed at a left side of the opening and provided to lock the door. The door may be rotatably installed at the left side of the opening or rotatably installed at the right side of the opening, and the first door latch or the second door latch may lock the door depending on whether the door is installed at the left side or the right side of the opening.

The first door latch may be provided to lock the door rotatably installed at the left side of the opening. The second door latch may be provided to lock the door rotatably installed at the right side of the opening.

The door may include a door base configured to open or close the opening, a door hinge rotatably installed at one end of the door base, and a lever tip installed at the other end of the door base. The door hinge may be removably installed at the left side of the opening or removably installed at the right side of the opening.

The lever tip may be locked by the first door latch when the door hinge is installed at the left side of the opening and may be locked by the second door latch when the door hinge is installed at the right side of the opening.

The clothes handling apparatus may further include a closure detector configured to detect closure of the door and a controller configured to control the door lock to lock the door in response to detection of the closure of the door by the closure detector.

The first door latch and the second door latch may be connected in parallel with the controller.

The first door latch and the second door latch may be connected in series with the controller.

The first door latch and the second door latch may be formed to be symmetrical to each other.

The first door latch and the second door latch may each include a closure detection switch provided to detect closure of the door, a solenoid provided to lock the door on the basis of detection of the closure of the door by the closure detection switch, and a locking detection switch provided to detect locking of the door.

The closure detection switch, a locking slider, the solenoid, and the locking detection switch of the first door latch may be disposed to be vertically symmetrical to the closure detection switch, a locking slider, the solenoid, and the locking detection switch of the second door latch.

In each of the first door latch and the second door latch, the closure detection switch and the solenoid may be connected in series with each other. The locking detection switch may be connected in parallel with the closure detection switch and the solenoid.

The first door latch and the second door latch may each further include a controller configured to output a door locking signal thereto. The solenoid may lock the door in response to the door locking signal while the closure detection switch is closed.

The locking detection switch may be closed by the solenoid. The controller may identify whether the door is locked on the basis of whether the locking detection switch is closed.

The first door latch and the second door latch may each include a catch cap caught by the lever tip provided in the door, a door slider configured to move from a first position to a second position due to the closed door and turn on the closure detection switch at the second position, and a locking slider configured to move from a third position to a fourth position due to the solenoid and fix the catch cap and turn on the locking detection switch at the fourth position.

The clothes handling apparatus may further include a closure detector configured to detect closure of the door and a controller configured to control the door lock to lock the door in response to detection of the closure of the door by the closure detector. The first door latch and the second door latch may each include a closure detection switch configured to be closed in response to the closure of the door, a solenoid provided to lock the door in response to a signal from the controller while the closure detection switch is closed, and a locking detection switch configured to be closed in response to locking of the door. The controller may identify whether the door is locked on the basis of whether the locking detection switch is closed.

In accordance with one aspect of the present disclosure, a clothes handling apparatus includes a cabinet having an opening formed in a front surface thereof, a door configured to open or close the opening, a door lock including a first door latch installed at a right side of the opening and provided to lock the door and a second door latch installed at a left side of the opening and provided to lock the door, and a controller configured to control the door lock to lock the door. The first door latch and the second door latch may be connected in parallel with the controller.

The first door latch may be provided to lock the door independently of an operation of the second door latch in response to a signal from the controller. The second door latch may be provided to lock the door independently of an operation of the first door latch in response to a signal from the controller.

In accordance with one aspect of the present disclosure, a clothes handling apparatus includes a cabinet having an opening formed in a front surface thereof, a door configured to open or close the opening, and a door lock including a first door latch installed at a right side of the opening and provided to lock the door and a second door latch installed at a left side of the opening and provided to lock the door. The door may be rotatably installed at the left side of the opening or rotatably installed at the right side of the opening. The first door latch and the second door latch may be formed to be symmetrical to each other.

The first door latch and the second door latch may each include a closure detection switch provided to detect closure of the door, a solenoid provided to lock the door on the basis of detection of the closure of the door by the closure detection switch, and a locking detection switch provided to detect locking of the door.

The closure detection switch, a locking slider, the solenoid, and the locking detection switch of the first door latch may be disposed to be vertically symmetrical to the closure detection switch, a locking slider, the solenoid, and the locking detection switch of the second door latch.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
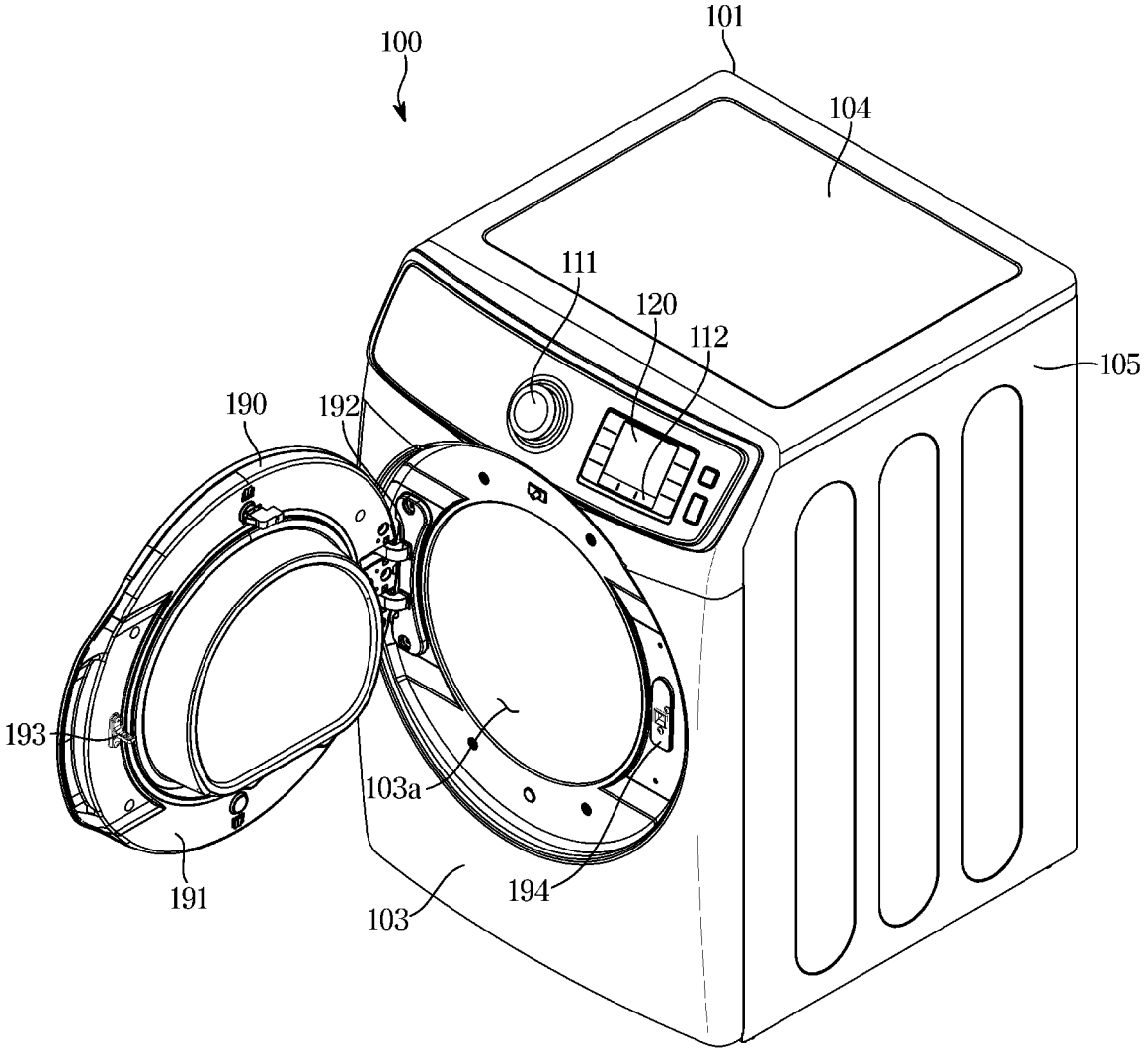
FIG. 1 illustrates an exterior of a clothes dryer according to an embodiment.

Like reference numerals refer to like elements throughout. Not all elements of embodiments are described herein, and general content in the art to which the disclosure pertains or overlapping content between embodiments will be omitted. Terms such as "part," "module," "member," and "block," when used herein, may be implemented by software or hardware. According to embodiments, a plurality of "parts," "modules," "members," or "blocks" may be implemented as a single element, or a single "part," "module," "member," or "block" may include a plurality of elements.

Throughout the specification, when a certain part is described as being "connected" to another part, both a case in which the certain part is indirectly connected to the other part as well as a case in which the certain part is directly connected to the other part are included therein, and the indirect connection includes a connection via a wireless network.

When a certain part is described as "including" a certain element, this signifies that the certain part may also include another element rather than excluding the other element unless particularly described otherwise.

Throughout the specification, when a certain member is described as being "on" another member, both a case in which still another member is present between the two members as well as a case in which the certain member is in contact with the other member are included therein.

Terms such as "first" and "second" are used to distinguish one element from another element, and an element is not limited by the above-mentioned terms.

A singular expression includes a plural expression unless context clearly indicates otherwise.

Reference numerals for steps are used for convenience of description and are not intended to describe an order of the steps. The steps may be performed in a different order from the stated order unless context clearly describes a specific order.

Hereinafter, an action principle and embodiments of the disclosure will be described with reference to the accompanying drawings.

Figure 2:
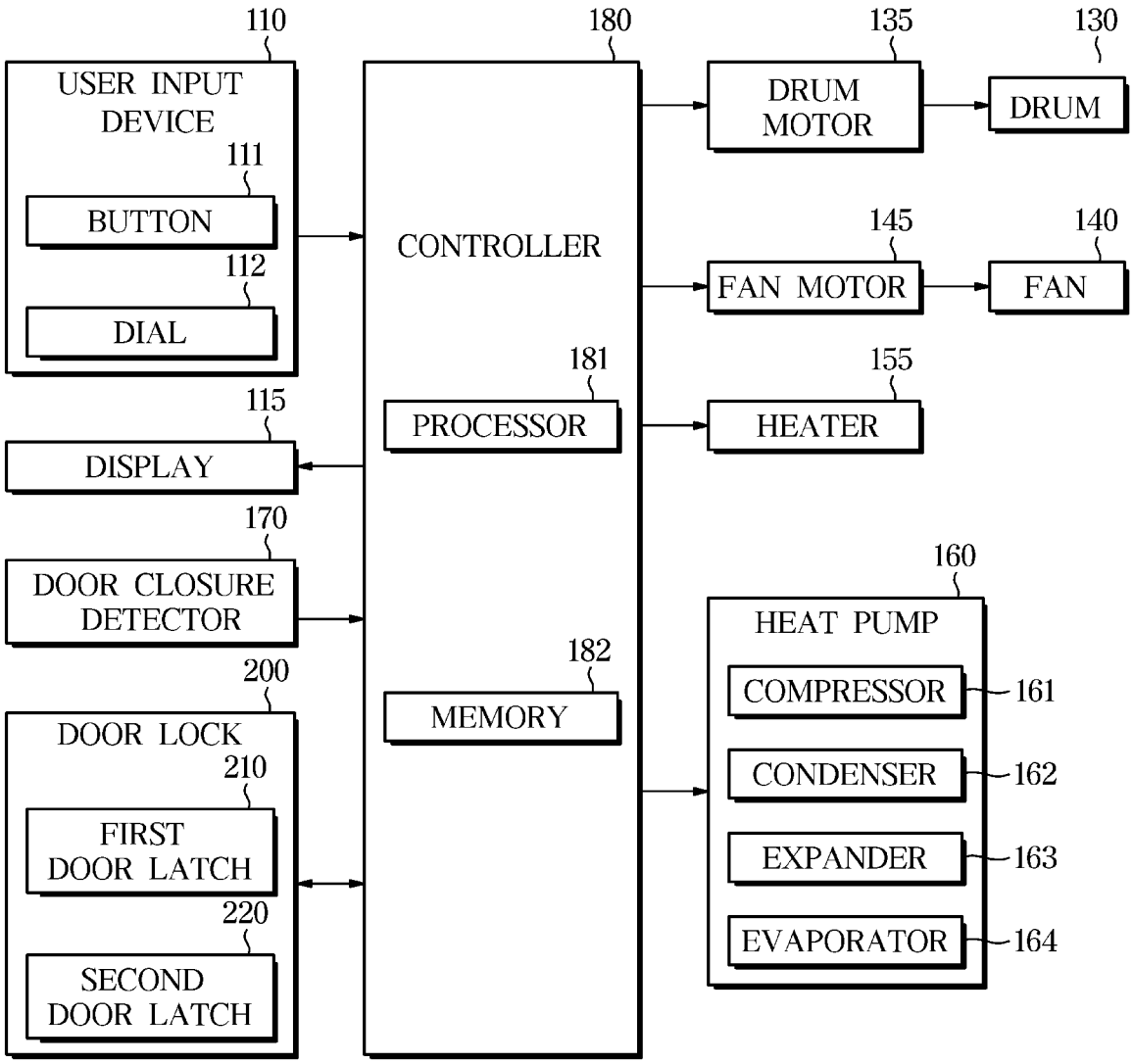
FIG. 2 illustrates a configuration of the clothes dryer according to an embodiment.
Figure 3:
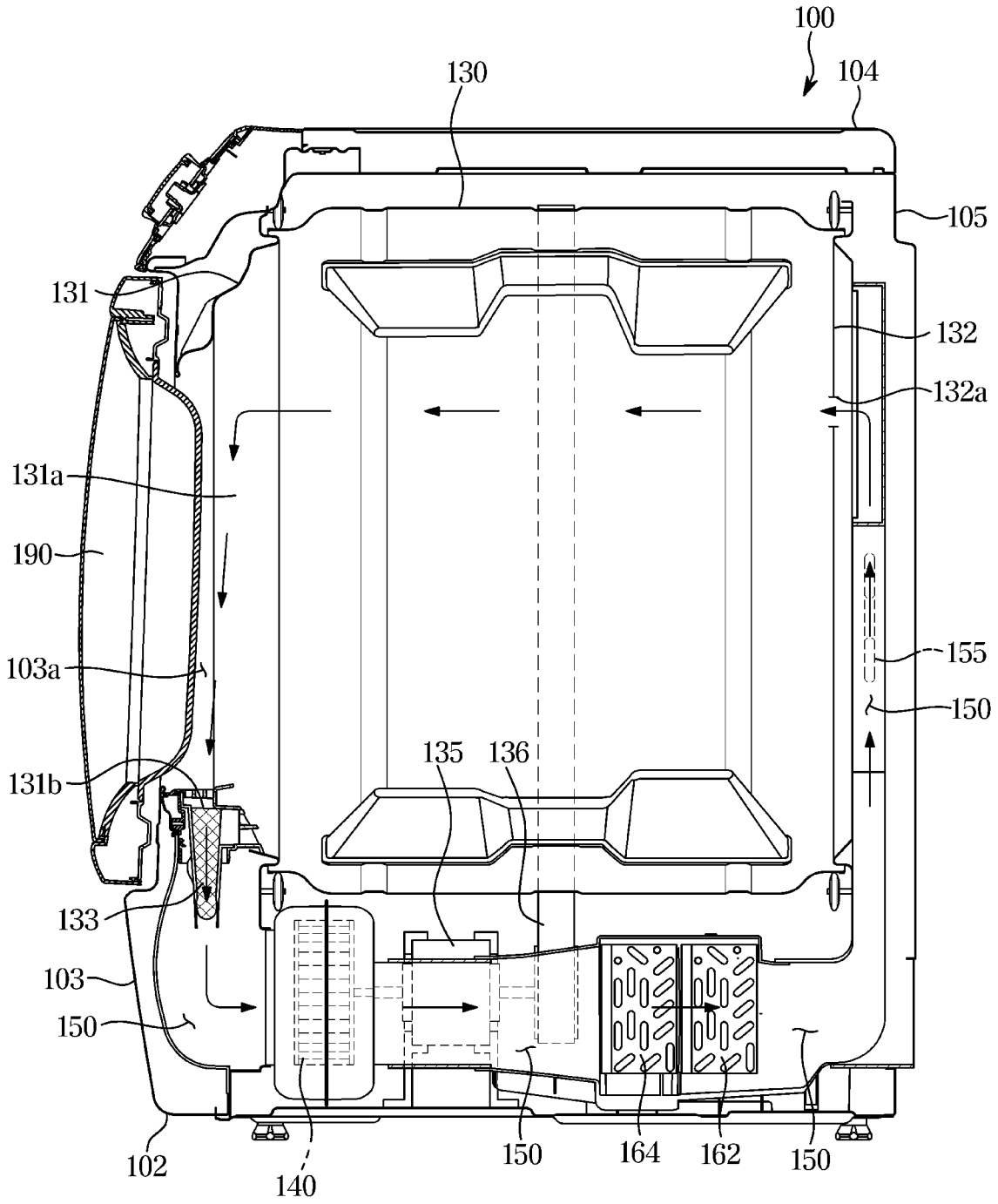
FIG. 3 illustrates a side cross-section of the clothes dryer according to an embodiment.
Figure 4:
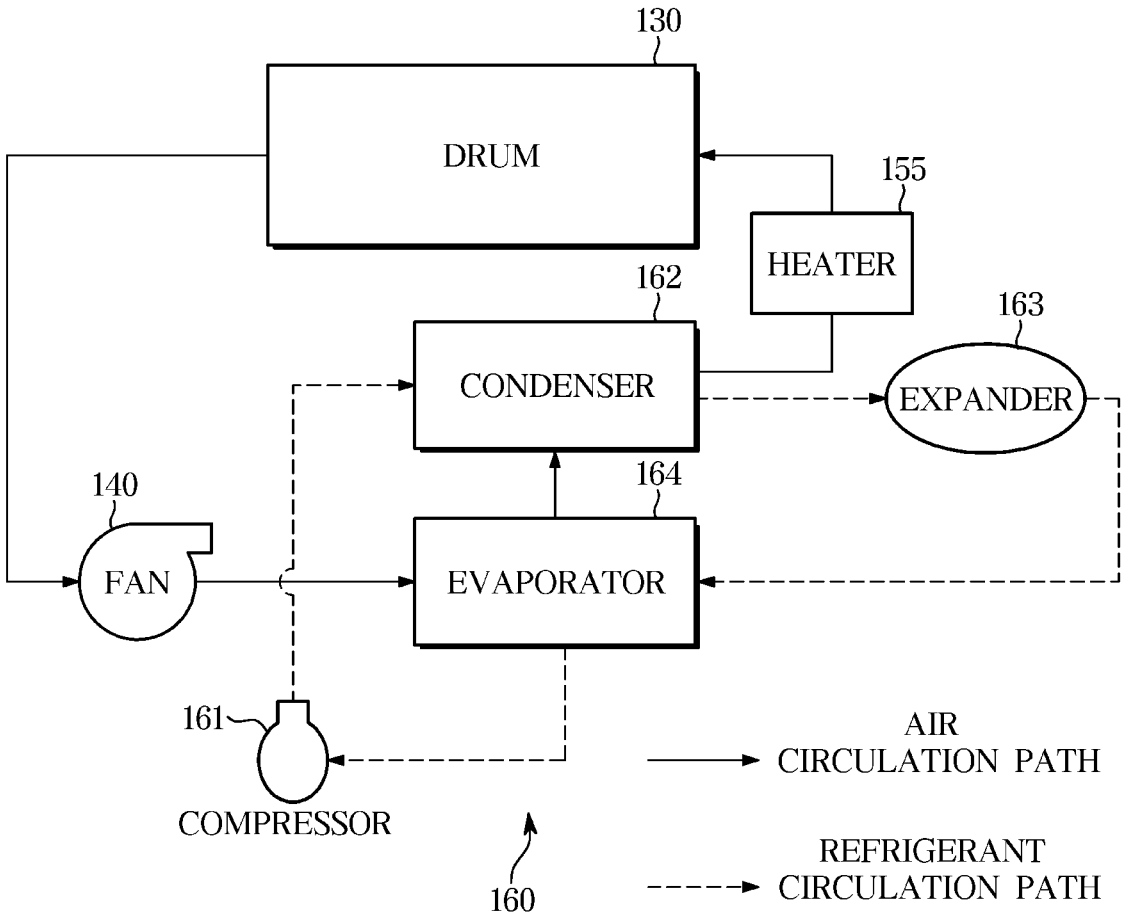
FIG. 4 illustrates circulation of air due to the clothes dryer according to an embodiment.
Figure 5:
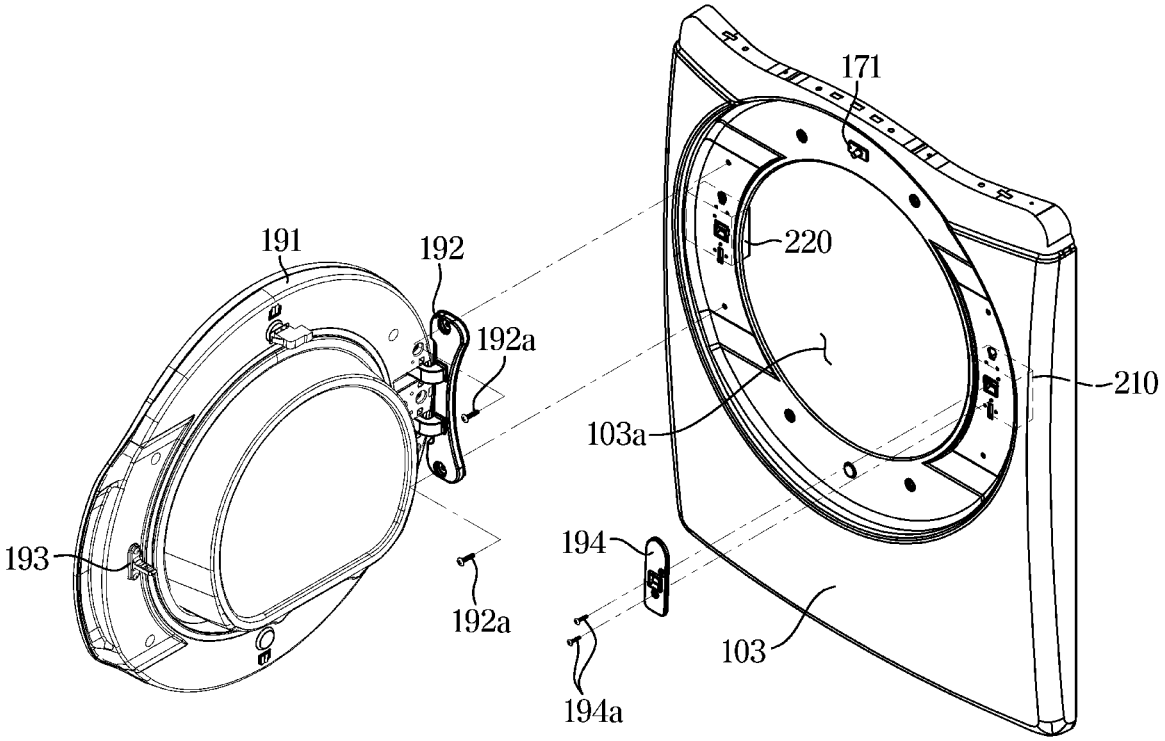
FIG. 5 illustrates coupling between a main body and a door of the clothes dryer according to an embodiment.
Figure 6:
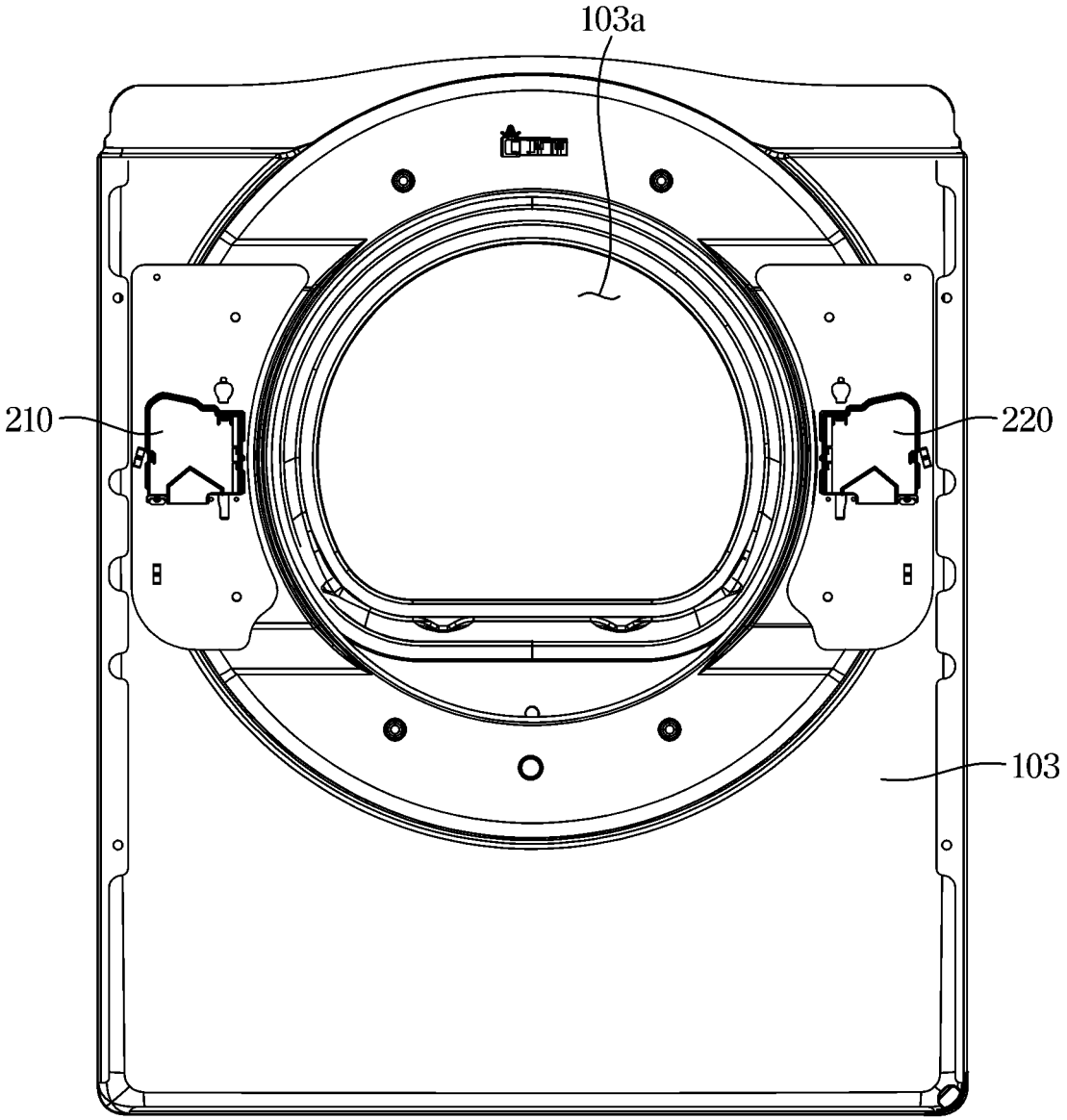
FIG. 6 illustrates first and second door latches included in the clothes dryer according to an embodiment.
Figure 7:
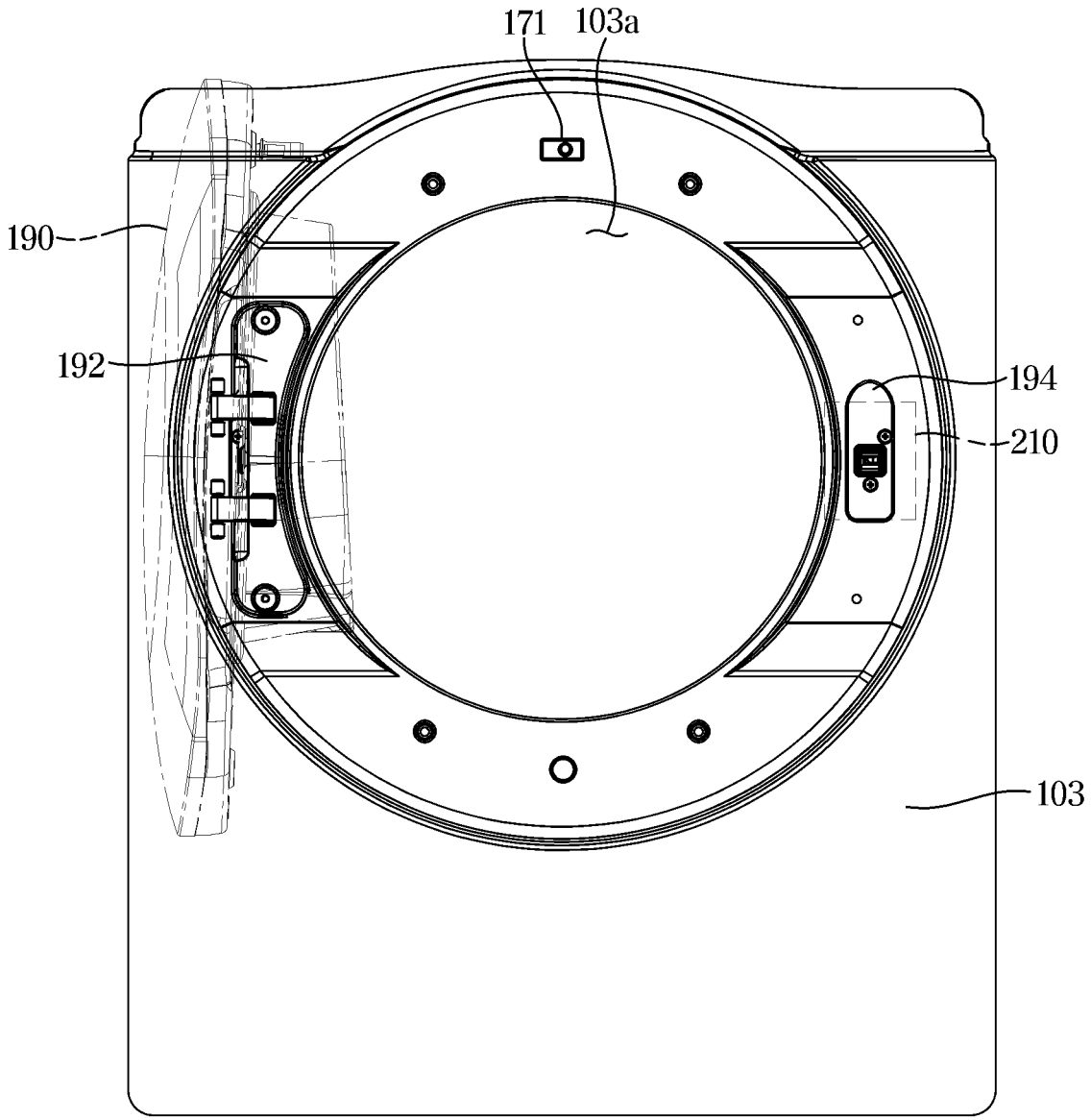
FIG. 7 illustrates a state in which a door is coupled to a left side of a front cover of the clothes dryer according to an embodiment.
Figure 8:
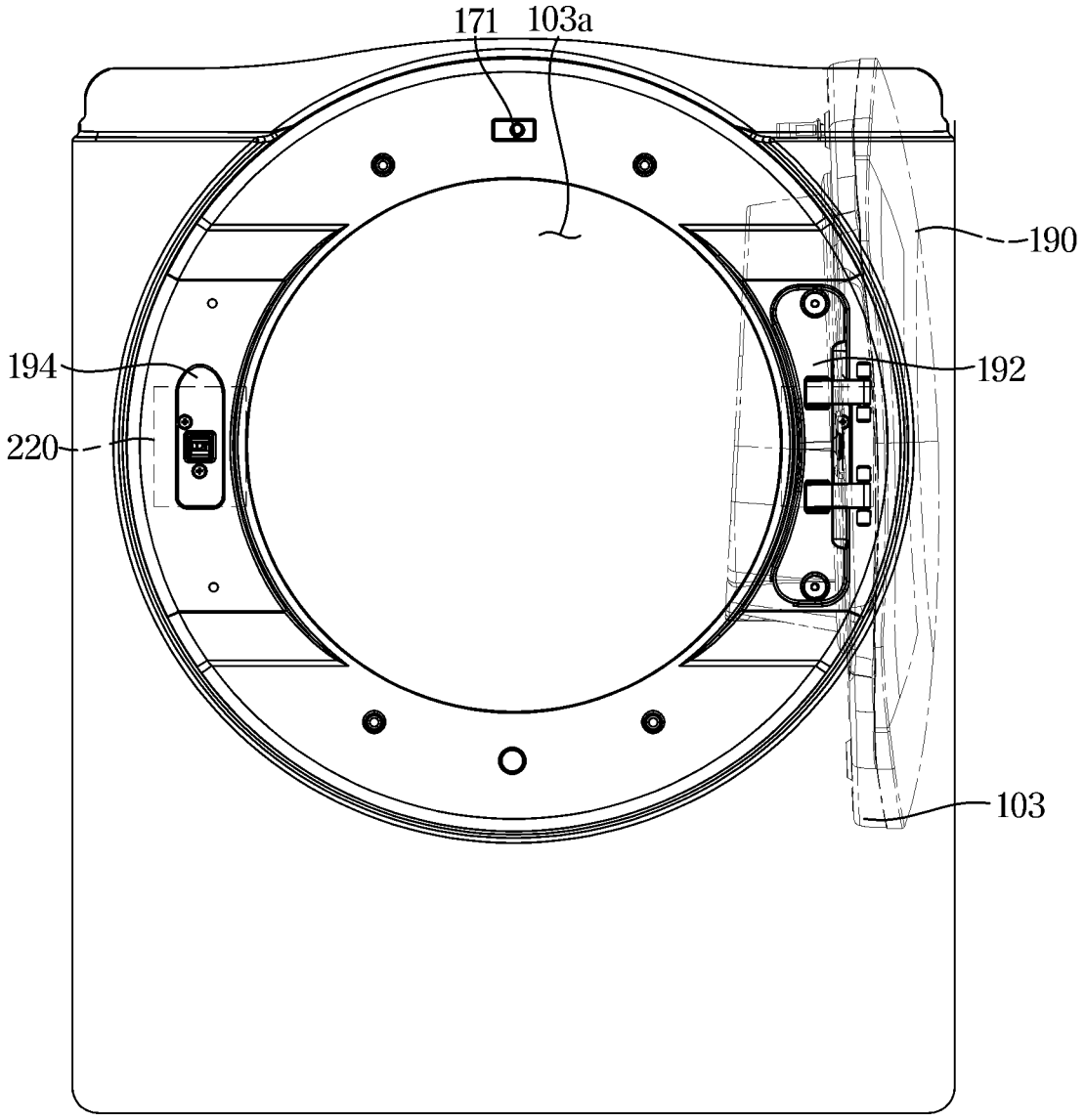
FIG. 8 illustrates a state in which the door is coupled to a right side of the front cover of the clothes dryer according to an embodiment.

FIG. 1 illustrates an exterior of a clothes dryer according to an embodiment. FIG. 2 illustrates a configuration of the clothes dryer according to an embodiment. FIG. 3 illustrates a side cross-section of the clothes dryer according to an embodiment. FIG. 4 illustrates circulation of air due to the clothes dryer according to an embodiment. FIG. 5 illustrates coupling between a main body and a door of the clothes dryer according to an embodiment. FIG. 6 illustrates first and second door latches included in the clothes dryer according to an embodiment. FIG. 7 illustrates a state in which a door is coupled to a left side of a front cover of the clothes dryer according to an embodiment. FIG. 8 illustrates a state in which the door is coupled to a right side of the front cover of the clothes dryer according to an embodiment.

A dryer 100 is one kind of clothes handling apparatuses.

The dryer 100 refers to an apparatus which rotates a drum accommodating an object to be dried and supplies high-temperature air into the drum to dry the object to be dried. Here, the object to be dried encompasses any object which may be dried by high-temperature air. For example, the object to be dried is not limited and may be any object made of various kinds of fibers and fabrics, such as clothes and towels.

As illustrated in FIGS. 1, 2, and 3, the dryer 100 includes a rectangular parallelepiped cabinet 101. Also, the dryer 100 includes a user input device 110 provided inside or outside the cabinet 101, a display 115, a drum 130, a drum motor 135, a fan 140, a fan motor 145, a duct 150, a heater 155, a heat pump 160, a door closure detector 170, a door lock 200, and a controller 180.

The cabinet 101 may include a base plate 102, a front cover 103, a top cover 104, and a side-rear cover 105.

The user input device 110 and the display 115 for control of the dryer 100 may be disposed at an upper end of the front cover 103.

The user input device 110 may include a dial 111 which is gripped and rotated by a user to input a control command related to an operation of the dryer 100 and a button 112 which is pressed by the user to input a control command related to an operation of the dryer 100.

For example, the dryer 100 may include different drying courses for drying different objects to be dried, and the user may select any one of a plurality of drying courses by rotating the dial 111.

Also, the dryer 100 may include a power button for permitting or interrupting power supplied from an external power supply and an operational button for starting or stopping a drying operation of the dryer 100. The button 112 may include a push switch and a membrane switch, each of which is operated by being pressed by the user, or include a touch switch or the like which is operated by being in contact with a part of the user's body.

However, the user input device 110 is not limited to including the dial 111 and the button 112 and may include any means that allow a user to input a control command related to an operation of the dryer 100 to the dryer 100. For example, the user input device 110 may also include various known elements such as a remote controller configured to receive a control command from a user at a remote place and transmit the received control command to the dryer 100.

In this way, the user input device 110 may receive a control command related to the dryer 100 from the user and output an electrical signal corresponding to the received control command to the controller 180.

The display 115 may display an operational state of the dryer 100 and a control command from the user. For example, the display 115 may display a drying course selected by the user and display the time remaining until the end of drying during operation of the dryer 100.

The display 115 may be implemented using various types of known displays such as a light emitting diode (LED) panel, an organic light emitting diode (OLED) panel, or a liquid crystal display (LCD) panel. However, the display 115 is not limited thereto and may be any device capable of visually displaying various pieces of information related to the dryer 100.

The display 115 may also employ a touch screen panel (TSP) configured to receive a control command from a user and display operational information corresponding to the received control command. The TSP may include a display configured to display operational information and a control command which may be input by a user, a touch panel configured to detect coordinates of a point with which a part of the user's body has come in contact, and a touch screen controller configured to determine the control command input by the user on the basis of the coordinates of the point of contact detected by the touch panel. The touch screen controller may compare coordinates of the point of touch made by the user detected through the touch panel and coordinates of the control command displayed through the display and recognize the control command input by the user.

In this way, the display 115 may receive a control signal related to the display from the controller 180 and display an image corresponding to the received control signal.

The dryer 100 includes the drum 130 configured to accommodate an object to be dried and dry the object to be dried. The drum 130 may be rotatably installed in the cabinet 101.

The drum 130 may be formed in a cylindrical shape whose center of rotation is formed in a front-rear, horizontal direction. A front panel 131 having an opening 131*a* formed therein to allow an object to be dried to be put in the drum 130 may be disposed at a front surface of the drum 130. Also, a rear surface of the drum 130 may be closed by a rear panel 132 having an inlet 132*a* formed therein to allow introduction of high-temperature, dry air.

An outlet 131*b* through which air used in drying the object to be dried is discharged may be provided in the front panel 131 of the drum 130. A filter 133 configured to collect foreign substances removed from the object to be dried may be installed in the outlet 131*b*. Accordingly, the foreign substances removed from the object to be dried may be collected by the filter 133.

The drum 130 may receive a rotary force from a drum motor 135 and rotate. The drum 130 is connected to the drum motor 135 disposed in the cabinet 101 by a belt 136. The drum motor 135 may provide the rotary force to the drum 130 through the belt 136.

One or more heat sources may be provided in the dryer 100, and the dryer 100 may supply high-temperature air to the drum 130 through the heat sources. For example, the dryer 100 may include, as the heat sources, a heater 155 and a heat pump 160. In this case, dryers including a heat pump forming a refrigerant circuit may be classified into circulating type dryers and air discharge type dryers according to the flow of air being circulated. The circulating type dryer refers to a dryer capable of drying an object by circulating air without discharging or sucking air. The air discharge type dryer refers to a dryer which sucks outside air, uses the outside air in drying, and then discharges the outside air to the outside of the dryer.

The dryer 100 may include the fan 140 configured to circulate air inside the drum 130. The fan 140 may suck air from inside the drum 130 and discharge the air to the duct 150. By the fan 140, the air inside the drum 130 may circulate through the drum 130 and the duct 150.

The fan 140 may rotate by the fan motor 145. The fan motor 145 may rotate the fan 140 according to a control signal from the controller 180.

The heater 155 and the heat pump 160 may be provided in the duct 150 through which the air inside the drum 130 circulates.

As illustrated in FIG. 4, the heat pump 160 includes a compressor 161, a condenser 162, an evaporator 164, and an expander 163. The compressor 161, the condenser 162, the expander 163, and the evaporator 164 may be seated on the base plate 102 at a bottom surface of the cabinet 101.

The compressor 161 may compress refrigerant in a gaseous state to a high-temperature, high-pressure state and discharge the gaseous refrigerant in the high-temperature, high-pressure state. For example, the compressor 161 may compress refrigerant through reciprocating movement of a piston or rotation of a rotor. The discharged refrigerant may be transferred to the condenser 162.

The condenser 162 may condense the compressed gaseous refrigerant to a liquid. The condenser 162 may dissipate heat to surrounding portions thereof through the process of condensing the refrigerant. The condenser 162 may be provided in the duct 150 and heat the air through heat generated in the process of condensing the refrigerant. The heated air may be supplied to the drum 130. The liquid refrigerant condensed by the condenser 162 may be transferred to the expander 163.

The expander 163 may expand the high-temperature, high-pressure liquid refrigerant condensed by the condenser 162 to liquid refrigerant in a low-pressure state. For example, the expander 163 may include an expansion valve configured to adjust a pressure difference of the refrigerant. The expansion valve may include an electronic expansion valve (EEV) whose degree of opening may vary according to an electrical signal. The dryer 100 may control a flow rate of the refrigerant by adjusting the degree of opening of the expander 163 through a control signal.

The evaporator 164 may evaporate the liquid refrigerant expanded by the expander 163. As a result, the evaporator 164 may cause the low-temperature, low-pressure gaseous refrigerant to return to the compressor 161.

The evaporator 164 may absorb heat from surrounding portions thereof through an evaporation process in which the low-pressure liquid refrigerant is changed to gaseous refrigerant. The evaporator 164 may be provided in the duct 150 and may cool air passing through the evaporator 164 in the evaporation process.

Air around the evaporator 164 may be cooled by the evaporator 164, and, when a temperature of the air around the evaporator 164 becomes lower than the dew point, the air around the evaporator 164 may be condensed. The water due to condensation at the evaporator 164 may be collected by a water trap provided at a lower portion of the evaporator 164. The water collected by the water trap may move to a separate storage or be drained to the outside of the dryer 100.

Due to the condensation occurring around the evaporator 164, the absolute humidity of air passing through the evaporator 164 may be lowered. In other words, the amount of water vapor contained in the air passing through the evaporator 164 may be reduced.

Using the condensation occurring around the evaporator 164, the dryer 100 may reduce the amount of water vapor contained in the air inside the drum 130 and dry the object to be dried.

The evaporator 164 may be disposed more upstream than the condenser 162 on the basis of the flow of air due to the fan 140. The air circulating due to the fan 140 may be dried (water vapor may be condensed) by the evaporator 164 while the air passes through the evaporator 164, and then the air may be heated by the condenser 162 while passing through the condenser 162.

The heater 166 may assist the condenser 162 in heating the air. The heater 155 may heat air in the duct 150 in response to a control signal from the controller 180. For example, before the condenser 162 of the heat pump 160 sufficiently heats the air in the duct 150, the heater 155 may assist the condenser 162 in heating the air in the duct 150.

The temperature inside the drum 130 may more rapidly rise due to the heater 155 assisting the condenser 162, and the dryer 100 may more rapidly dry the object to be dried.

The heater 155 may be disposed more downstream than the condenser 162 on the basis of the flow of air due to the fan 140. The heater 155 may be implemented through a heating coil. However, the heater 155 is not limited thereto and may be implemented through various other known devices.

As illustrated in FIG. 5, an opening 103*a* formed in a substantially circular shape when viewed from the front is provided in the front cover 103 of the cabinet 101.

The opening 103*a* is opened or closed by a door 190 rotatably installed at the cabinet 101. Also, the drum 130 may be configured to allow an object to be dried to be put in the drum 130 or allow a dried object to be taken out of the drum 130 when the opening 103*a* is opened by the door 190.

The door 190 includes a door base 191 capable of opening or closing the opening 103*a*, a door hinge 192 configured to rotatably fix the door base 191 to one side of the cabinet 101 and a lever tip 193 provided to lock the door.

The door base 191 may cover the opening 103*a* of the cabinet 101. At least a portion of the door base 191 may be formed of a transparent material to allow a user to view the inside of the drum 130.

The door hinge 192 may be provided at one side of the door base 191. The door hinge 192 may rotatably fix the door base 191 to one side of the cabinet 101.

The door base 191 may rotate about the door hinge 192. The door base 191 may close or open the opening 103*a* of the cabinet 101 while rotating about the door hinge 192.

The door hinge 192 may be provided at one end of the door base 191 and removably installed at an outer side of the front cover 103 in the vicinity of the opening 103*a* of the cabinet 101.

The door hinge 192 may be installed at a left side of the opening 103*a* or installed at a right side of the opening 103*a*. The door 190 may be rotatably fixed to the left side of the opening 103*a* or rotatably fixed to the right side of the opening 103*a*, depending on a position at which the door hinge 192 is installed.

For example, the door hinge 192 may be provided at a left side end of the door base 191 and fixed to the left side of the opening 103*a* of the front cover 103. Thus, the door 190 may rotate about the left side of the opening 103*a* of the cabinet 101 and the left side end of the door base 191. In other words, the door 190 may open the opening 103*a* by rotating leftward and close the opening 103*a* by rotating rightward.

Also, the door hinge 192 may be provided at a right side end of the door base 191 and fixed to the right side of the opening 103*a* of the front cover 103. Thus, the door 190 may rotate about the right side of the opening 103*a* of the cabinet 101 and the right side end of the door 190. In other words, the door 190 may open the opening 103*a* by rotating rightward and close the opening 103*a* by rotating leftward.

The lever tip 193 may be installed at the opposite side of the door hinge 192 on the door base 191.

When the door hinge 192 is disposed at the left side end of the door base 191, the lever tip 193 may be disposed at the right side end of the door base 191 and be inserted into a hole in the right side of the opening 103*a* when the door 190 is closed. Also, when the door hinge 192 is disposed at the right side end of the door base 191, the lever tip 193 may be disposed at the left side end of the door base 191 and be inserted into a hole in the left side of the opening 103*a* when the door 190 is closed.

The lever tip 193 may be inserted into a door lock 200, which will be described below, when the door 190 closes the opening 103*a*.

The lever tip 193 may be fixed by the door lock 200. A hollow may be formed in the center of the lever tip 193, and the hollow of the lever tip 193 may be fixed by a catch cap which will be described below.

When the lever tip 193 is fixed by the door lock 200, the door 190 may keep the opening 103*a* closed and may be unable to be opened by an external force. In other words, the door 190 is locked by the door lock 200.

The door 190 may be disposed at a position at which the door 190 opens the opening 103*a* and a position at which the door 190 closes the opening 103*a*. Also, when the door 190 is disposed at the position at which the door 190 closes the opening 103*a*, the door 190 may be locked by the door lock 200 or unlocked by the door lock 200.

The door closure detector 170 may detect a closed state of the door 190 and an opened state of the door 190.

For example, the door closure detector 170 may include a push switch 171 disposed in the vicinity of the opening 103*a* of the cabinet 101. The push switch 171 may be unable to be pressed when the door 190 opens the opening 103*a*. Also, the push switch 171 may be pressed by the door 190 when the door 190 closes the opening 103*a*.

The door closure detector 170 may output a signal indicating that the door 190 is opened or a signal indicating that the door 190 is closed to the controller 180 on the basis of whether the push switch 171 is pressed. For example, the door closure detector 170 may output the signal indicating that the door 190 is opened to the controller 180 in response to the push switch 171 not being pressed. Also, the door closure detector 170 may output the signal indicating that the door 190 is closed to the controller 180 in response to the push switch 171 being pressed.

As illustrated in FIG. 6, the door lock 200 may include a first door latch 210 and a second door latch 220 which are capable of locking the door 190.

The first door latch 210 and the second door latch 220 may be provided at an inner side of the front cover 103 of the cabinet 101. As illustrated in FIG. 6, the first door latch 210 may be installed at the left side of the opening 103*a* when viewed from the rear of the front cover 103, that is, at the right side of the opening 103*a* when viewed from the front of the cabinet 101. As illustrated in FIG. 6, the second door latch 220 may be installed at the right side of the opening 103*a* when viewed from the rear of the front cover 103, that is, at the left side of the opening 103*a* when viewed from the front of the cabinet 101.

As illustrated in FIG. 7, the door 190 may be rotatably fixed at the left side of the opening 103*a*.

The user may fix the door hinge 192 at the left side of the opening 103*a* of the front cover 103 by using a screw 192*a* (see FIG. 5). Also, the user may fix a hole cover 194 at the right side of the opening 103*a* of the front cover 103 by using a screw 194*a* (see FIG. 5). The hole cover 194 may be installed at a hole at the opposite side of the door hinge 192, that is, the right side of the opening 103*a* of the front cover 103.

When the door 190 is fixed to the left side of the opening 103*a*, the door hinge 192 is disposed at the left side end of the door base 191, and the lever tip 193 is disposed at the right side end of the door base 191. Thus, the door 190 is closed by rotating rightward from the left side, and the first door latch 210 provided at the right side of the opening 103*a* may fix the lever tip 193 of the door 190.

In this way, due to the first door latch 210 being installed at the right side of the opening 103*a*, the user may install the door 190 at the left side of the opening 103*a* of the front cover 103 without removing the front cover 103 from the cabinet 101.

As illustrated in FIG. 8, the door 190 may be rotatably fixed at the right side of the opening 103*a*.

The user may fix the door hinge 192 to the right side of the opening 103*a* of the front cover 103 by using a screw (see FIG. 5). Also, the user may fix the hole cover 194 to the right side of the opening 103*a* of the front cover 103 by using a screw (see FIG. 5). The hole cover 194 may be installed at a hole at the opposite side of the door hinge 192, that is, the left side of the opening 103*a* of the front cover 103.

When the door 190 is fixed to the right side of the opening 103*a*, the door hinge 192 is disposed at the right side end of the door base 191, and the lever tip 193 is disposed at the left side end of the door base 191. Thus, the door 190 is closed by rotating leftward from the right side, and the second door latch 220 provided at the left side of the opening 103*a* may fix the lever tip 193 of the door 190.

In this way, due to the second door latch 220 being installed at the left side of the opening 103*a*, the user may install the door 190 at the right side of the opening 103*a* of the front cover 103 without removing the front cover 103 from the cabinet 101.

The first door latch 210 and the second door latch 220 may each fix the lever tip 193 of the door 190 in response to a door locking signal from the controller 180. In other words, the door lock 200 may lock the door 190 in response to the door locking signal from the controller 180.

Also, the first door latch 210 and the second door latch 220 may each lock the door 190 depending on whether the door 190 is closed. In other words, the first door latch 210 and the second door latch 220 may lock the door 190 in a state in which the door 190 is closed.

In this way, the door lock 200 may detect closure of the door 190 separately from the door closure detector 170. In other words, when the door 190 is not detected by the door closure detector 170, the door 190 is not locked, and the drying operation does not start. Also, when the door closure detector 170 detects the door 190 but closure of the door 190 is not detected by the door lock 200, the door 190 is not locked, and the drying operation does not start.

Thus, erroneous detection of the closure of the door 190 is reduced, and the drying operation is prevented from starting while the door 190 is open.

The first door latch 210 and the second door latch 220 will be described in more detail below.

The controller 180 may include a memory 182 configured to store a program and data for controlling the operation of the dryer 100 and a processor 181 configured to generate a control signal for controlling the operation of the dryer 100 according to the program and data stored in the memory 182. The memory 182 and the processor 181 may be implemented with separate chips or implemented with a single chip. Also, the controller 180 may include a plurality of memories or a plurality of processors.

The memory 182 may store a program and data for controlling the drying operation according to each drying course. For example, the memory 182 may store a speed of rotation of the drum 130 according to each drying course, a set temperature inside the drum 130 according to each drying course, and the like.

Also, the memory 182 may store a user input received through the user input device 110 or store information related to the operation of the dryer 100 (for example, the time remaining until the end of drying).

The memory 182 may include a volatile memory such as a static random access memory (S-RAM) and a dynamic random access memory (D-RAM) and a non-volatile memory such as a read-only memory (ROM), an erasable programmable read-only memory (EPROM), and an electrically erasable programmable read-only memory (EEPROM).

The memory 182 may include a single memory device or a plurality of memory devices.

The processor 181 may process data according the program provided from the memory 182 and generate a control signal on the basis of a processing result.

The processor 181 may process a user input received through the user input device 110 and an output signal of the door closure detector 170 and generate a control signal for controlling the door lock 200, the drum motor 135, the fan motor 145, the heater 155, and the heat pump 160 on the basis of a processing result.

For example, the processor 181 may output a control signal for controlling the door lock 200 to lock the door 190 to the door lock 200 in response to a user input indicating a start of an operation and a signal indicating closure of the door 190.

Also, the processor 181 may determine a drying course according to the user input. The processor 181 may determine a speed of rotation of the drum 130 according to the drying course and output a control signal corresponding to the determined speed of rotation to the drum motor 135. The processor 181 may determine a set temperature inside the drum 130 according to the drying course and output a control signal according to the determined set temperature to the heater 155 and the heat pump 160.

The processor 181 may include an arithmetic circuit, a storage circuit, and a control circuit. The processor 181 may include a single chip or include a plurality of chips. Also, the processor 181 may include a single core or include a plurality of cores.

Figure 9:
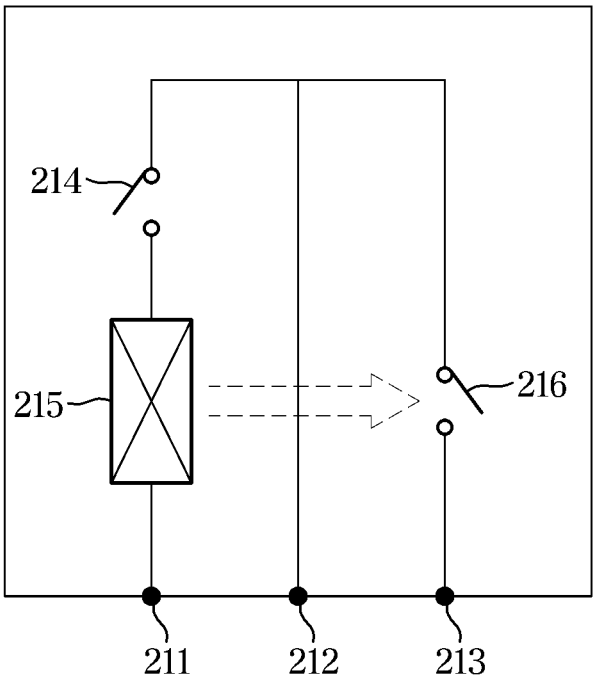
FIG. 9 illustrates a simple configuration of the first door latch included in the clothes dryer according to an embodiment.

FIG. 9 illustrates a simple configuration of the first door latch included in the clothes dryer according to an embodiment.

Hereinafter, the first door latch 210 will be described. The second door latch 220 may be configured to be vertically symmetrical to the first door latch 210.

As illustrated in FIG. 9, the first door latch 210 includes a first door locking terminal 211, a first neutral terminal 212, a first locking detection terminal 213, a first closure detection switch 214, a first solenoid 215, and a first locking detection switch 216.

Each of the first door locking terminal 211, the first neutral terminal 212, and the first locking detection terminal 213 may be connected to the controller 180.

The first closure detection switch 214 may detect whether the door 190 is closed. Specifically, the first closure detection switch 214 may detect whether the lever tip 193 disposed at the right side end of the door 190 is inserted into the first door latch 210 when the door 190 is installed at the left side of the opening 103*a* of the front cover 103.

The lever tip 193 of the door 190 is not inserted into the first door latch 210 while the door 190 is open. When the lever tip 193 of the door 190 is not inserted into the first door latch 210, the first closure detection switch 214 is opened (turned off).

Also, the lever tip 193 of the door 190 is inserted into the first door latch 210 when the door 190 is closed. When the lever tip 193 of the door 190 is inserted into the first door latch 210, the first closure detection switch 214 is closed (turned on).

One end of the first closure detection switch 214 is connected to the first solenoid 215. The other end of the first closure detection switch 214 may be connected to the first neutral terminal 212 and the first locking detection switch 216.

The first solenoid 215 may lock or unlock the door 190 in response to a door locking signal from the controller 180.

For example, the first solenoid 215 may generate a magnetic field in response to an electrical pulse. A first magnetic body inserted into the first solenoid 215 may perform translational movement due to the magnetic field of the first solenoid 215. The lever tip 193 of the door 190 may be fixed to the first door latch 210 due to the movement of the first magnetic body. In other words, the first solenoid 215 may convert an electrical signal to the translational movement of the first magnetic body, and the door 190 is locked due to the translational movement of the first magnetic body.

Also, the first magnetic body inserted into the first solenoid 215 interlocks with the first locking detection switch 216. Specifically, when the door 190 is locked due to the first magnetic body, simultaneously, the first magnetic body may close (turn on) the first locking detection switch 216. Also, when the door 190 is unlocked due to the first magnetic body, simultaneously, the first magnetic body may open (turn off) the first locking detection switch 216. In other words, the first solenoid 215 may open or close the first locking detection switch 216 in response to the door locking signal from the controller 180.

One end of the first solenoid 215 is connected to the first door locking terminal 211, and the other end of the first solenoid 215 is connected to the first closure detection switch 214.

Therefore, the first door locking terminal 211, the first solenoid 215, the first closure detection switch 214, and the first neutral terminal 212 may be electrically connected to each other in that order.

When the first closure detection switch 214 is closed (turned on), a circuit formed of the first door locking terminal 211, the first solenoid 215, the first closure detection switch 214, the first neutral terminal 212, and the controller 180 may be closed. Therefore, the door locking signal output from the controller 180 may drive the first solenoid 215. In other words, when the first closure detection switch 214 is closed (turned on), the controller 180 may lock the door 190 and unlock the door 190 using the first solenoid 215.

On the other hand, when the first closure detection switch 214 is opened (turned off), the circuit formed of the first door locking terminal 211, the first solenoid 215, the first closure detection switch 214, the first neutral terminal 212, and the controller 180 may be opened. Therefore, the door locking signal output from the controller 180 is not transmitted to the first solenoid 215. In other words, when the first closure detection switch 214 is opened (turned off), the controller 180 is unable to lock the door 190 using the first solenoid 215.

The first closure detection switch 214 may detect whether the door 190 is locked. Specifically, when the door 190 is installed at the left side of the opening 103*a* of the front cover 103, the first locking detection switch 216 may detect whether the lever tip 193 disposed at the right side end of the door 190 is fixed to the first door latch 210.

The first solenoid 215 may lock or unlock the door 190 in response to the door locking signal from the controller 180. The first solenoid 215 may simultaneously lock the door 190 and close (turn on) the first locking detection switch 216. Also, the first solenoid 215 may simultaneously unlock the door 190 and open (turn off) the first locking detection switch 216.

One end of the first locking detection switch 216 is connected to the first neutral terminal 212. The other end of the first locking detection switch 216 may be connected to the first locking detection terminal 213.

When the first locking detection switch 216 is closed (turned on), a circuit formed of the first locking detection terminal 213, the first locking detection switch 216, the first neutral terminal 212, and the controller 180 may be closed. Therefore, through the first locking detection terminal 213, the controller 180 may identify that the door 190 is locked.

On the other hand, when the first locking detection switch 216 is opened (turned off), the circuit formed of the first locking detection terminal 213, the first locking detection switch 216, the first neutral terminal 212, and the controller 180 may be opened. Therefore, through the first locking detection terminal 213, the controller 180 may identify that the door 190 is unlocked.

In this way, the first closure detection switch 214 may be closed in response to closing of the door 190. When the first closure detection switch 214 is closed, the controller 180 may drive the first solenoid 215 so that the door 190 is locked. The first locking detection switch 216 may be closed (turned on) by driving of the first solenoid 215, and, from the closure of the first locking detection switch 216, the controller 180 may identify that the door 190 is locked.

The second door latch 220 includes the same configuration as the first door latch 210. For example, the second door latch 220 may include a second door locking terminal, a second neutral terminal, a second locking terminal, a second closure detection switch, a second solenoid, and a second locking detection switch.

The elements of the second door latch 220 may be disposed to be vertically symmetrical to the elements of the first door latch 210. For example, when, in the first door latch 210, the first door locking terminal 211, the first neutral terminal 212, and the first locking detection terminal 213 are disposed in that order from left to right, in the second door latch 220, the second locking detection terminal, the second neutral terminal, and the second door locking terminal may be disposed in that order from left to right.

Figure 10:
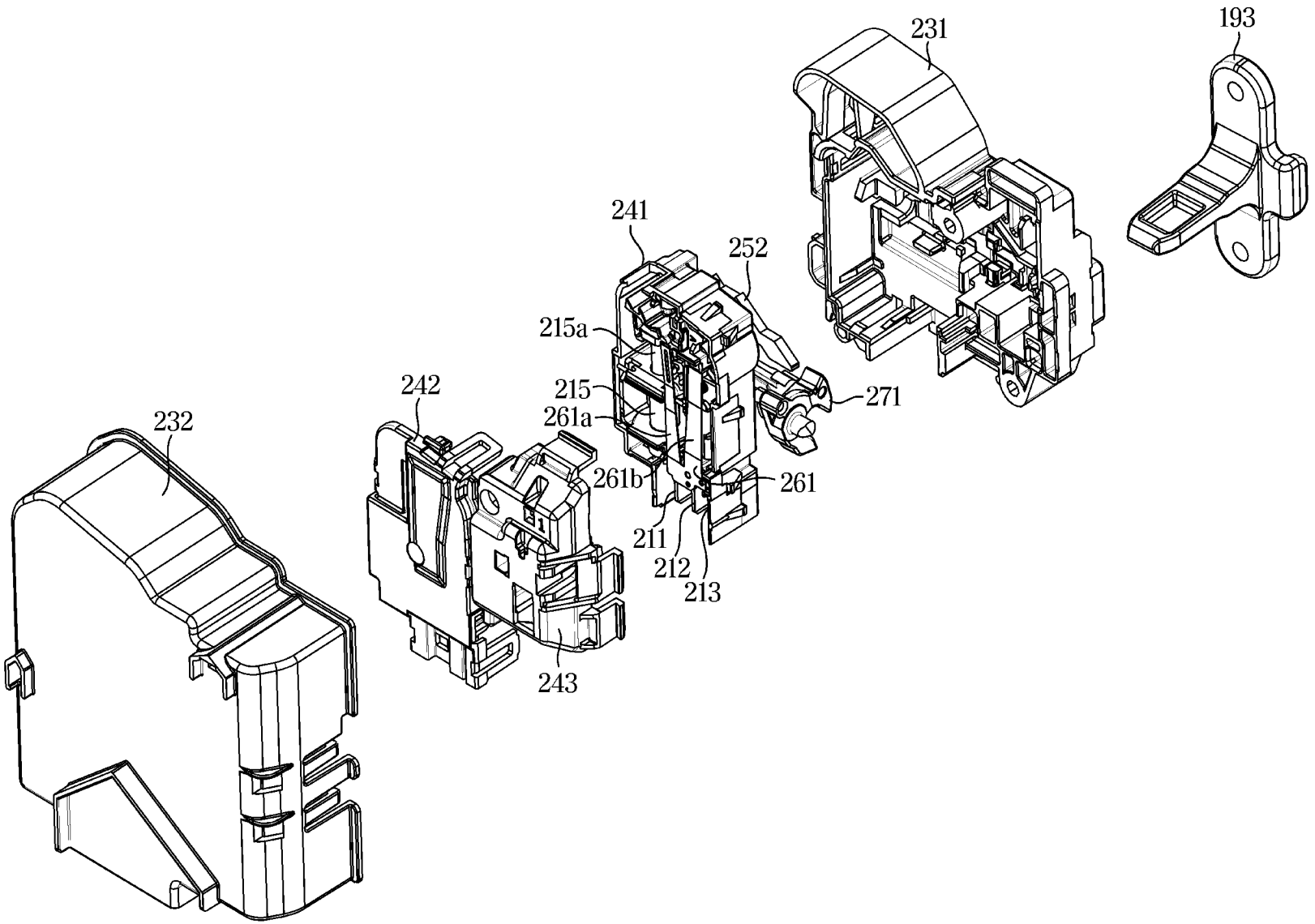
FIG. 10 illustrates an exploded view of the first door latch included in the clothes dryer according to an embodiment.
Figure 11:
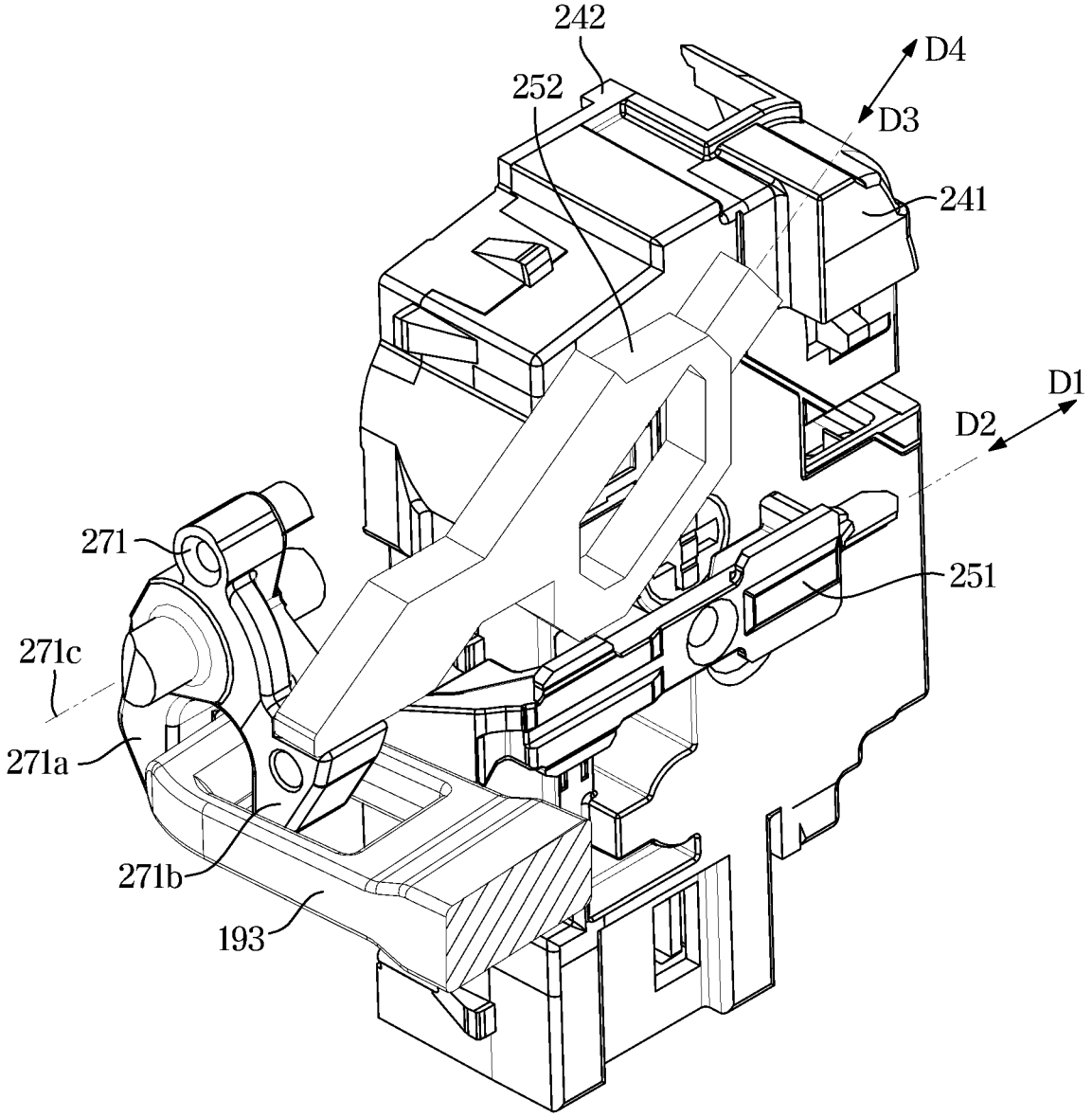
FIG. 11 illustrates a state in which the first door latch included in the clothes dryer according to an embodiment locks the door.

FIG. 10 illustrates an exploded view of the first door latch included in the clothes dryer according to an embodiment. FIG. 11 illustrates a state in which the first door latch included in the clothes dryer according to an embodiment locks the door.

Referring to FIGS. 10 and 11, the first door latch 210 may include a first housing 231 and a second housing 232 which are configured to protect the elements of the first door latch 210 from the outside. The first housing 231 is disposed behind the front cover 103 of the dryer 100, and the second housing 232 is disposed behind the first housing 231. A hole 231*a* into which the lever tip 193 of the door 190 is inserted may be provided in the first housing 231, and the lever tip 193 may pass through the hole 231*a* and be inserted into the first door latch 210.

A first cover 241 in which an accommodation space for accommodating the elements of the first door latch 210 is formed is provided in the first housing 231 and the second housing 232. One side of the first cover 241 may be open, and the open side surface of the first cover 241 may be sealed by a second cover 242.

The first solenoid 215, a first magnetic body 215*a*, the first door locking terminal 211, the first neutral terminal 212, the first locking detection terminal 213, and a switch plate 261 may be provided in the accommodation space of the first cover 241. Also, a door slider 251 and a locking slider 252 may be provided in front of the first cover 241, and a catch cap 271 may be provided at the left side of the first cover 241.

The catch cap 271 may be rotatably seated on a third cover 243 disposed at the left side of the second cover 242. The catch cap 271 may be formed substantially in the shape of alphabet "A" and include a first leg 271*a* and a second leg 271*b*.

While the door 190 is opened, the catch cap 271 may have a first posture in which a space between the first leg 271*a* and the second leg 271*b* faces the front.

When the door 190 is closed, the lever tip 193 passes through the hole 231*a* of the first housing 231. Also, the lever tip 193 is seated in the space between the first leg 271*a* and the second leg 271*b*. The lever tip 193 applies a pushing force to the first leg 271*a*, and the catch cap 271 rotates about a rotating shaft 271*c*.

Due to the rotation, the catch cap 271 may have a second posture in which the space between the first leg 271*a* and the second leg 271*b* faces the lower side.

When the door 190 is closed, due to the lever tip 193 passing through the hole 231*a* of the first housing 231, the door slider 251 may move in a first direction D1 (rightward in FIG. 11) as illustrated in FIG. 11.

Due to the movement of the door slider 251 in the first direction D1, the first closure detection switch 214 is closed (turned on).

The first closure detection switch 214 may be formed of the switch plate 261 and the one end of the first solenoid 215.

The switch plate 261 electrically comes in contact with the first neutral terminal 212. Also, the switch plate 261 may be formed substantially in the shape of alphabet "V" and include a first contact plate 261*a* and a second contact plate 261*b*.

While the door 190 is opened, the first contact plate 261*a* is spaced apart from the one end of the first solenoid 215 due to the door slider 251. In other words, the first closure detection switch 214 is opened (turned off).

When the door 190 is closed, as the door slider 251 moves in the first direction D1, the first contact plate 261*a* comes in contact with the one end of the first solenoid 215. In other words, the first closure detection switch 214 is closed (turned on).

The first solenoid 215 and the first magnetic body 215*a* may be provided in the accommodation space of the first cover 241. The one end of the first solenoid 215 forms the first closure detection switch 214 together with the first contact plate 261*a*. The other end of the first solenoid 215 may be electrically connected to the first door locking terminal 211.

The first magnetic body 215*a* may be movably inserted into the first solenoid 215. When electricity is supplied to the first solenoid 215, the first solenoid 215 may generate a magnetic field, and the first magnetic body 215*a* may perform translational movement due to the magnetic field of the first solenoid 215.

The controller 180 may output a door locking signal in order to lock the door 190. The first solenoid 215 may lock the door 190 in response to the door locking signal from the controller 180. When the first solenoid 215 generates a magnetic field due to the electrical signal (door locking signal) supplied from the controller 180, the first magnetic body 215*a* may move upward due to the magnetic field of the first solenoid 215.

The movement of the first magnetic body 215*a* may be transferred to the locking slider 252 via mechanical devices included in the first door latch 210, and the locking slider 252 may move in a third direction D3 (toward the lower left side in FIG. 11).

Due to the movement of the locking slider 252 in the third direction D3, rotation of the catch cap 271 is restricted as illustrated in FIG. 11. Since the rotation of the catch cap 271 is restricted, the lever tip 193 is fixed to the first door latch 210. In other words, since the rotation of the catch cap 271 is restricted, the door 190 is locked.

Also, due to the movement of the locking slider 252 in the third direction D3, the first locking detection switch 216 is closed (turned on).

The first locking detection switch 216 may be formed of the switch plate 261 and the first locking detection terminal 213.

As described above, the switch plate 261 may include the first contact plate 261*a* and the second contact plate 261*b*.

While the door 190 is unlocked, the second contact plate 261*b* is spaced apart from the first locking detection terminal 213 due to the locking slider 252. In other words, the first locking detection switch 216 is opened (turned off).

While the door 190 is locked, as the locking slider 252 moves in the third direction D3, the second contact plate 261*b* comes in contact with the first locking detection terminal 213. In other words, the first locking detection switch 216 is closed (turned on).

On the basis of the opening of the first locking detection switch 216, the controller 180 may identify that the door 190 is unlocked. On the basis of the closing of the first locking detection switch 216, the controller 180 may identify that the door 190 is locked.

The controller 180 may output a door unlocking signal in order to unlock the door 190. The first solenoid 215 may unlock the door 190 in response to the door unlocking signal from the controller 180. When the first solenoid 215 generates a magnetic field due to the electrical signal (door unlocking signal) supplied from the controller 180, the first magnetic body 215*a* may move upward again due to the magnetic field of the first solenoid 215.

The movement of the first magnetic body 215*a* may be transferred to the locking slider 252 via the mechanical devices included in the first door latch 210, and the locking slider 252 may move in a fourth direction D4 (toward the upper right side in FIG. 11).

Due to the movement of the locking slider 252 in the fourth direction D4, the rotation of the catch cap 271 is permitted. Since the rotation of the catch cap 271 is possible, the lever tip 193 is released from the first door latch 210. In other words, the door 190 is unlocked.

Also, due to the movement of the locking slider 252 in the fourth direction D4, the second contact plate 261*b* is spaced apart from the first locking detection terminal 213. In other words, the first locking detection switch 216 is opened (turned off).

When the door 190 is opened, the door slider 251 may move in a second direction D2 (leftward in FIG. 11).

Due to the movement of the door slider 251 in the second direction D2, the first contact plate 261*a* is spaced apart from the one end of the first solenoid 215. In other words, the first closure detection switch 214 is opened (turned off).

In this way, the first door latch 210 may include the door slider 251 which moves due to the lever tip 193, and, due to the movement of the door slider 251, the first closure detection switch 214 may be closed (turned on) or opened (turned off).

Also, the first door latch 210 includes the locking slider 252 which moves due to the operation of the first solenoid 215, and, due to the movement of the locking slider 252, the door 190 is locked or unlocked. Also, due to the movement of the locking slider 252, the first locking detection switch 216 may be closed (turned on) or opened (turned off).

The second door latch 220 includes the same configuration as the first door latch 210. For example, the second door latch 220 may include a second solenoid, a door slider, a locking slider, and a switch plate.

The elements of the second door latch 220 may be disposed to be vertically symmetrical to the elements of the first door latch 210. Also, the elements of the second door latch 220 may move in a manner vertically symmetrical to the elements of the first door latch 210.

Figure 12:
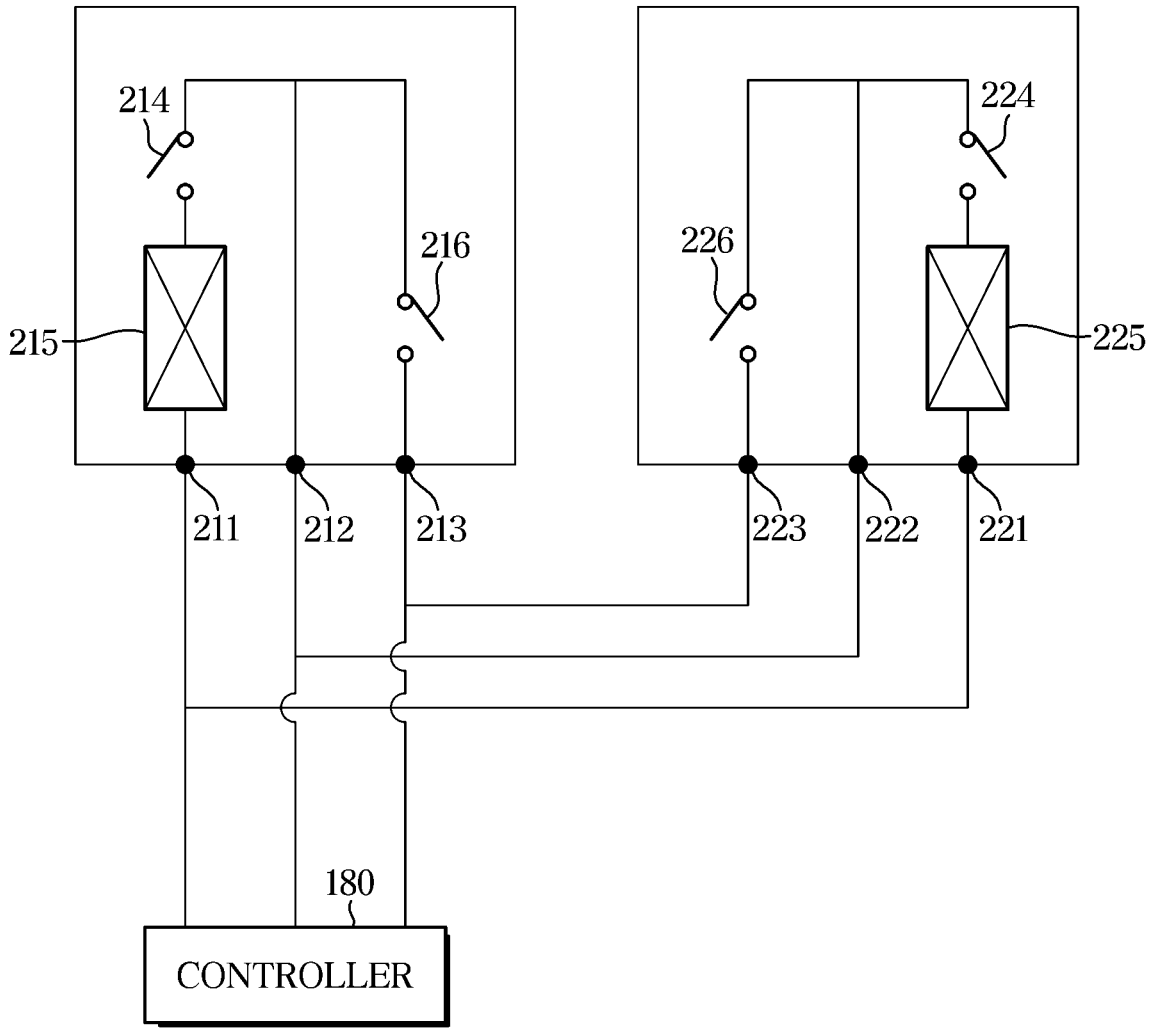
FIG. 12 illustrates an example of connection between a controller and a door lock included in the clothes dryer according to an embodiment.

FIG. 12 illustrates an example of connection between a controller and a door lock included in the clothes dryer according to an embodiment. FIGS. 13, 14, 15 and 16 illustrate operations of the door lock due to the connection illustrated in FIG. 12.

As illustrated in FIG. 12, the dryer 100 includes the controller 180, the first door latch 210, and the second door latch 220.

The first door locking terminal 211, the first neutral terminal 212, and the first locking detection terminal 213, which are connected to the controller 180, are provided in the first door latch 210.

The first door latch 210 includes the first closure detection switch 214 configured to detect closure of the door 190, the first solenoid 215 configured to generate a dynamic force for locking the door 190, and the first locking detection switch 216 configured to detect locking of the door 190.

A second door locking terminal 221, a second neutral terminal 222, and a second locking detection terminal 223, which are connected to the controller 180, are provided in the second door latch 220.

The second door latch 220 includes a second closure detection switch 224, a second solenoid 225, and a second locking detection switch 226. The configurations and functions of the second closure detection switch 224, the second solenoid 225, and the second locking detection switch 226 are the same as those of the first closure detection switch 214, the first solenoid 215, and the first locking detection switch 216.

As illustrated in FIG. 12, the first closure detection switch 214, the first solenoid 215, and the first locking detection switch 216 which are included in the first door latch 210 may be disposed to be vertically symmetrical to the second closure detection switch 224, the second solenoid 225, and the second locking detection switch 226 which are included in the second door latch 220. Also, the first door locking terminal 211, the first neutral terminal 212, and the first locking detection terminal 213 may be disposed to be vertically symmetrical to the second door locking terminal 221, the second neutral terminal 222, and the second locking detection terminal 223.

The first door latch 210 and the second door latch 220 may be connected in parallel with the controller 180. The first door locking terminal 211 may be connected to the controller 180 together with the second door locking terminal 221, and the first neutral terminal 212 may be connected to the controller 180 together with the second neutral terminal 222. Also, the first locking detection terminal 213 may be connected to the controller 180 together with the second locking detection terminal 223.

Thus, the first closure detection switch 214 and the first solenoid 215 are connected in parallel with the second closure detection switch 224 and the second solenoid 225. Also, the first locking detection switch 216 is connected in parallel with the second locking detection switch 226.

The controller 180 may output a door locking signal, and the door locking signal of the controller 180 may be input to the first door latch 210 through the first door locking terminal 211 and be input to the second door latch 220 through the second door locking terminal 221. Since the first door latch 210 and the second door latch 220 are connected in parallel with the controller 180, a signal output from the controller 180 may be input to both the first door latch 210 and the second door latch 220.

The first solenoid 215 may be driven by the door locking signal depending on whether the first closure detection switch 214 is closed (turned on), and the second solenoid 225 may be driven by the door locking signal depending on whether the second closure detection switch 224 is closed (turned on).

The controller 180 may identify that the door 190 is locked, on the basis of the first locking detection switch 216 and the second locking detection switch 226 being closed (turned on). Since the first locking detection switch 216 and the second locking detection switch 226 are connected in parallel with each other, the controller 180 may identify that the door 190 is locked when any one of the first locking detection switch 216 and the second locking detection switch 226 is closed (turned on).

Figure 13:
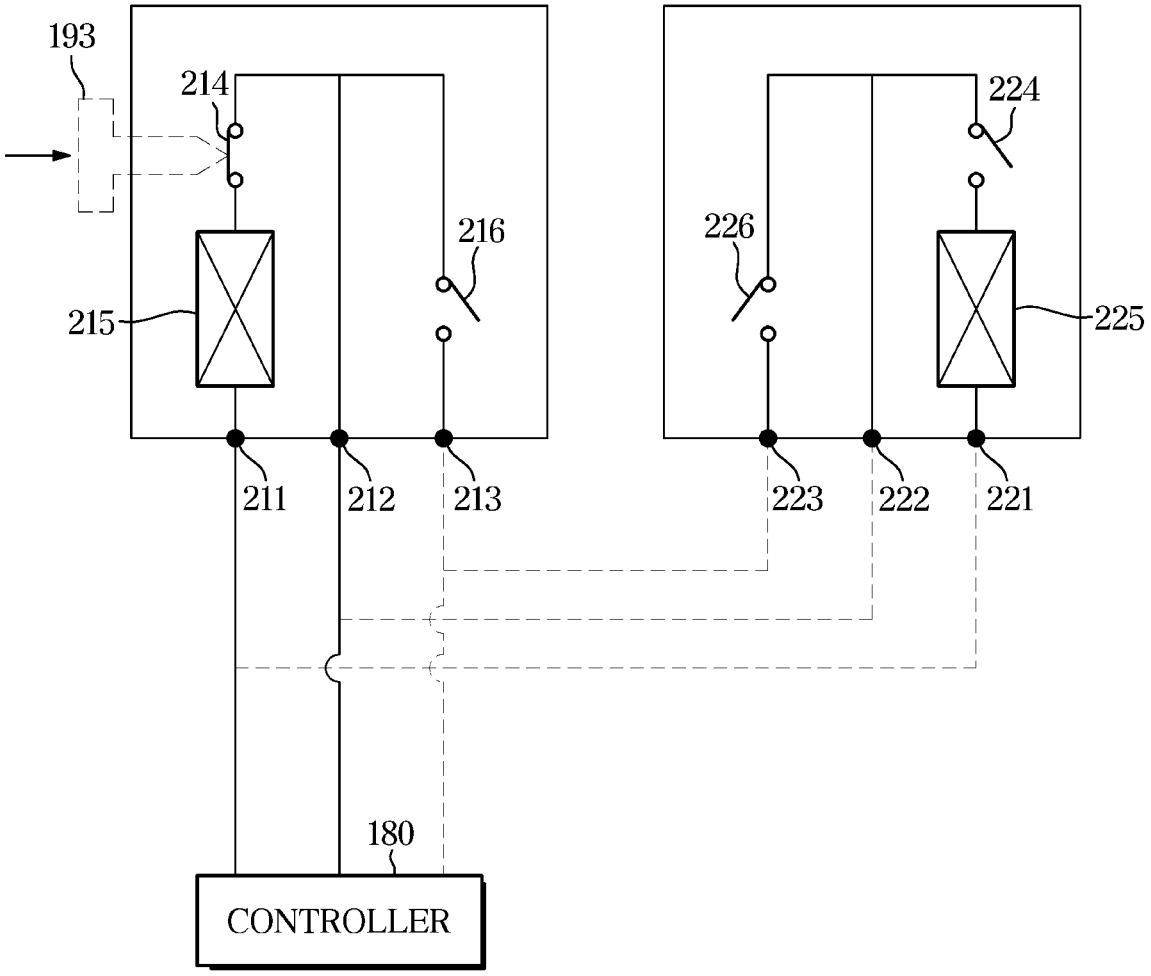
FIGS. 13, 14, 15 and 16 illustrate operations of the door lock due to the connection illustrated in FIG. 12.

For example, the door hinge 192 may be disposed at the left side of the opening 103*a* of the front cover 103, and the lever tip 193 may be disposed at the right side end of the door 190. When the door 190 is closed, as illustrated in FIG. 13, the lever tip 193 may be inserted into the first door latch 210, and the first closure detection switch 214 may be closed (turned on) due to the lever tip 193. The second closure detection switch 224 of the second door latch 220 may be in an open (off) state.

Figure 14:
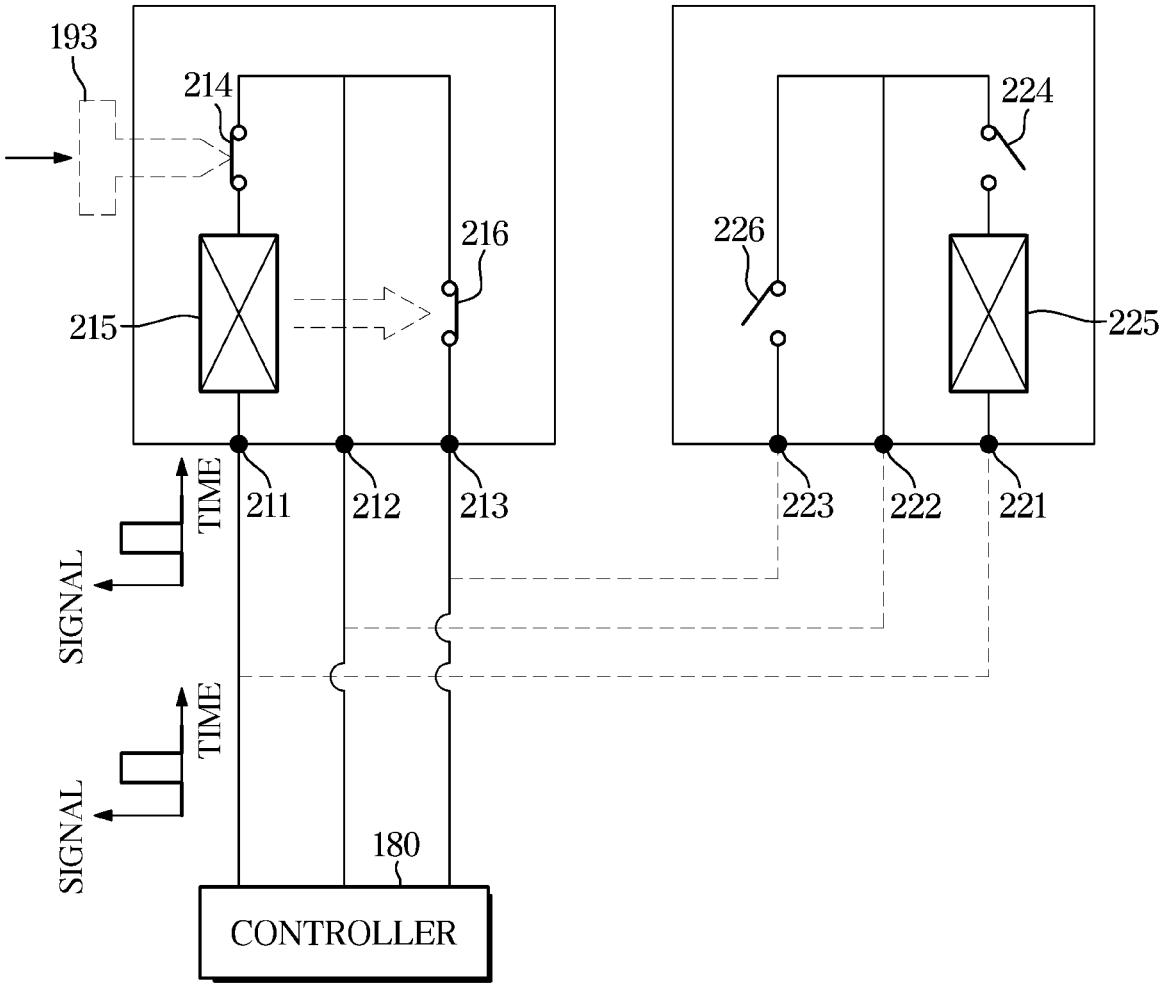

As illustrated in FIG. 14, the controller 180 may output a door locking signal. Since the first closure detection switch 214 is in a closed (on) state, the door locking signal may be input to the first solenoid 215. The first solenoid 215 may be driven by the door locking signal, and, due to the driving of the first solenoid 215, the door 190 may be locked, and the first locking detection switch 216 may be closed (turned on).

On the other hand, since the second closure detection switch 224 is in the open (off) state, the door locking signal is not input to the second solenoid 225. The second solenoid 225 is not driven, and the second locking detection switch 226 may maintain being opened (turned off).

On the basis of the first locking detection switch 216 being closed (turned on), the controller 180 may identify that the door 190 is locked.

Figure 15:
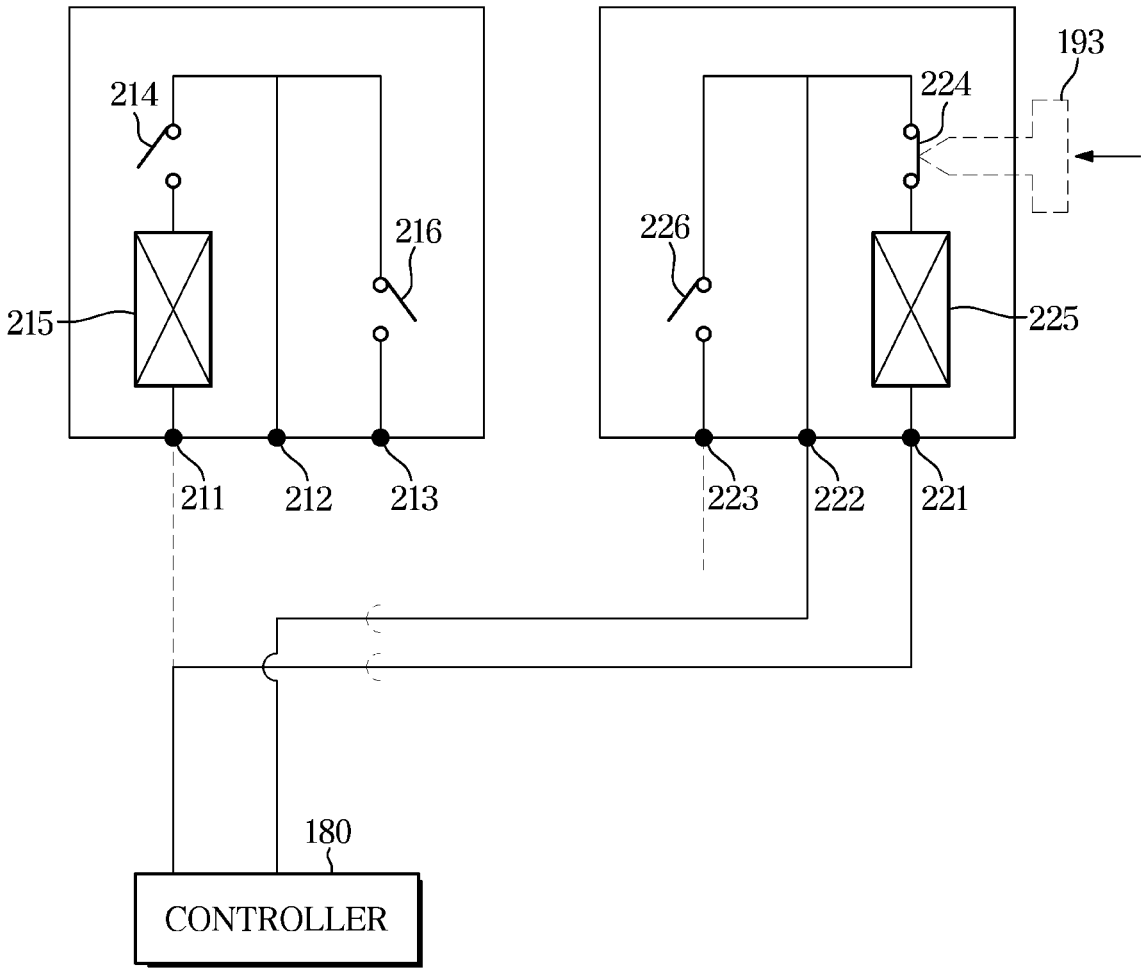

Also, the door hinge 192 may be disposed at the right side of the opening 103*a* of the front cover 103, and the lever tip 193 may be disposed at the left side end of the door 190. When the door 190 is closed, as illustrated in FIG. 15, the lever tip 193 may be inserted into the second door latch 220, and the second closure detection switch 224 may be closed (turned on) due to the lever tip 193. The first closure detection switch 214 of the first door latch 210 may be in an open (off) state.

Figure 16:
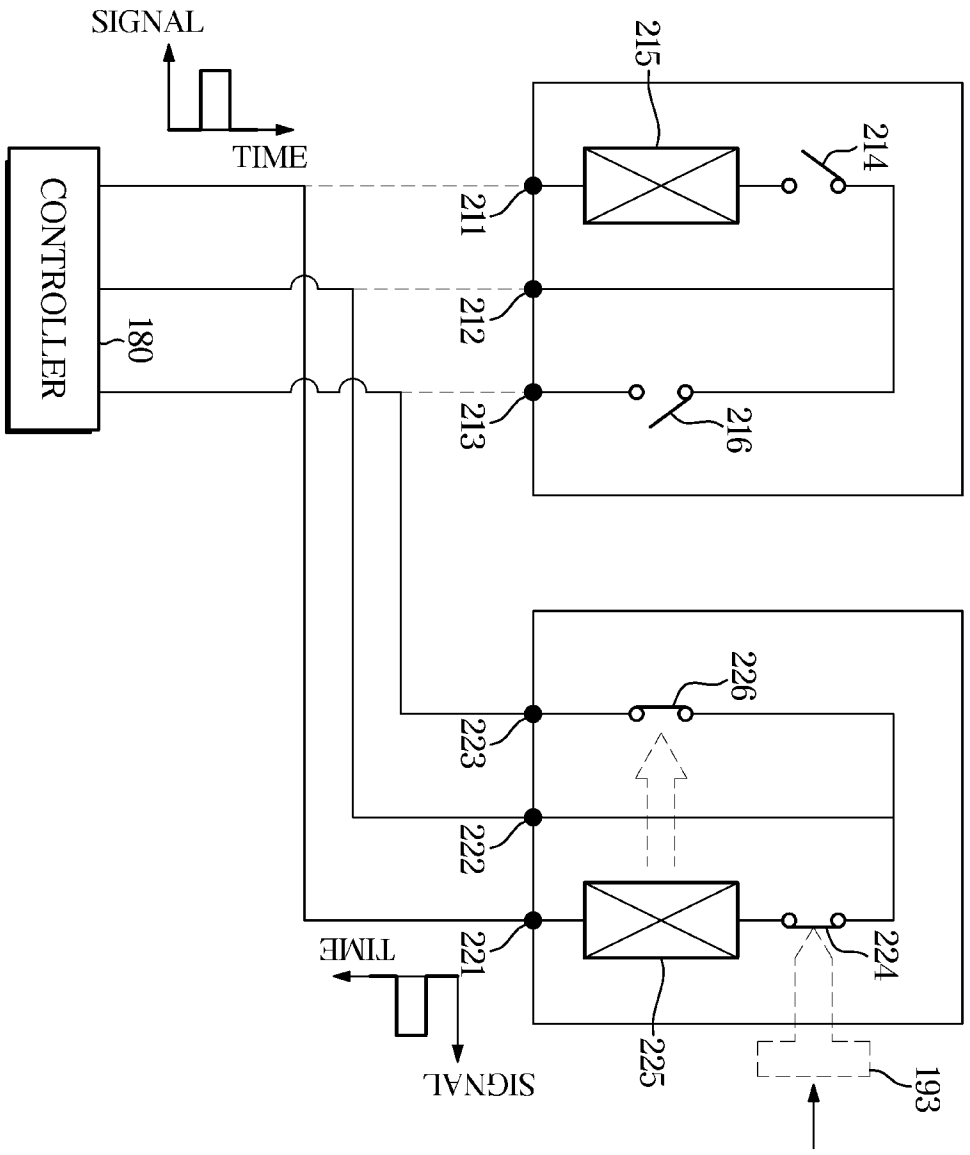

As illustrated in FIG. 16, the controller 180 may output a door locking signal. Since the second closure detection switch 224 is in the closed (on) state, the door locking signal may be input to the second solenoid 225. The solenoid 225 may be driven by the door locking signal, and, due to the driving of the second solenoid 225, the door 190 may be locked, and the second locking detection switch 226 may be closed (turned on).

On the other hand, since the first closure detection switch 214 is in the open (off) state, the door locking signal is not input to the first solenoid 215. The first solenoid 215 is not driven, and the first locking detection switch 216 may maintain being opened (turned off).

On the basis of the second locking detection switch 226 being closed (turned on), the controller 180 may identify that the door 190 is locked.

Figure 17:
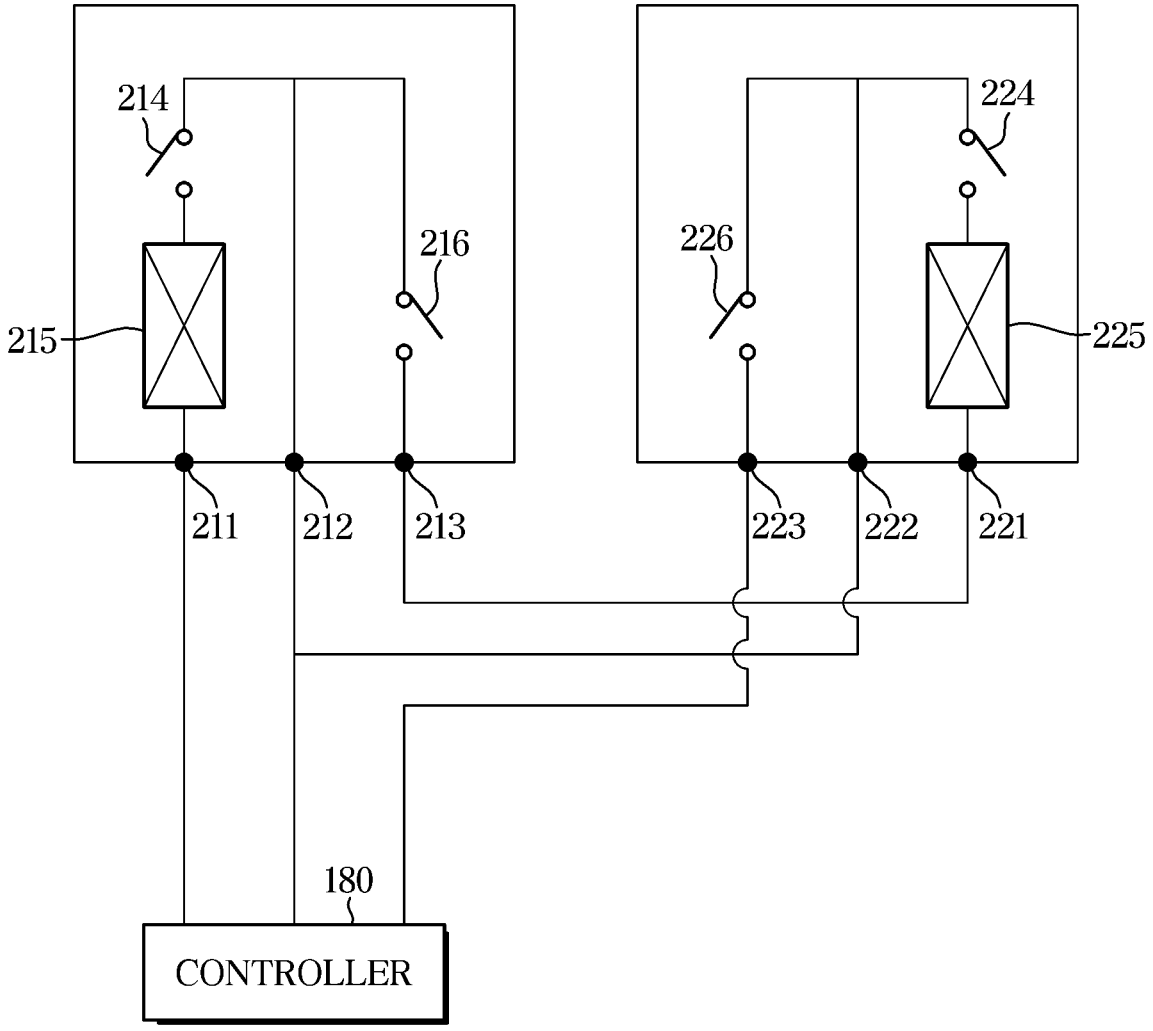
FIG. 17 illustrates another example of the connection between the controller and the door lock included in the clothes dryer according to an embodiment.
Figure 18:
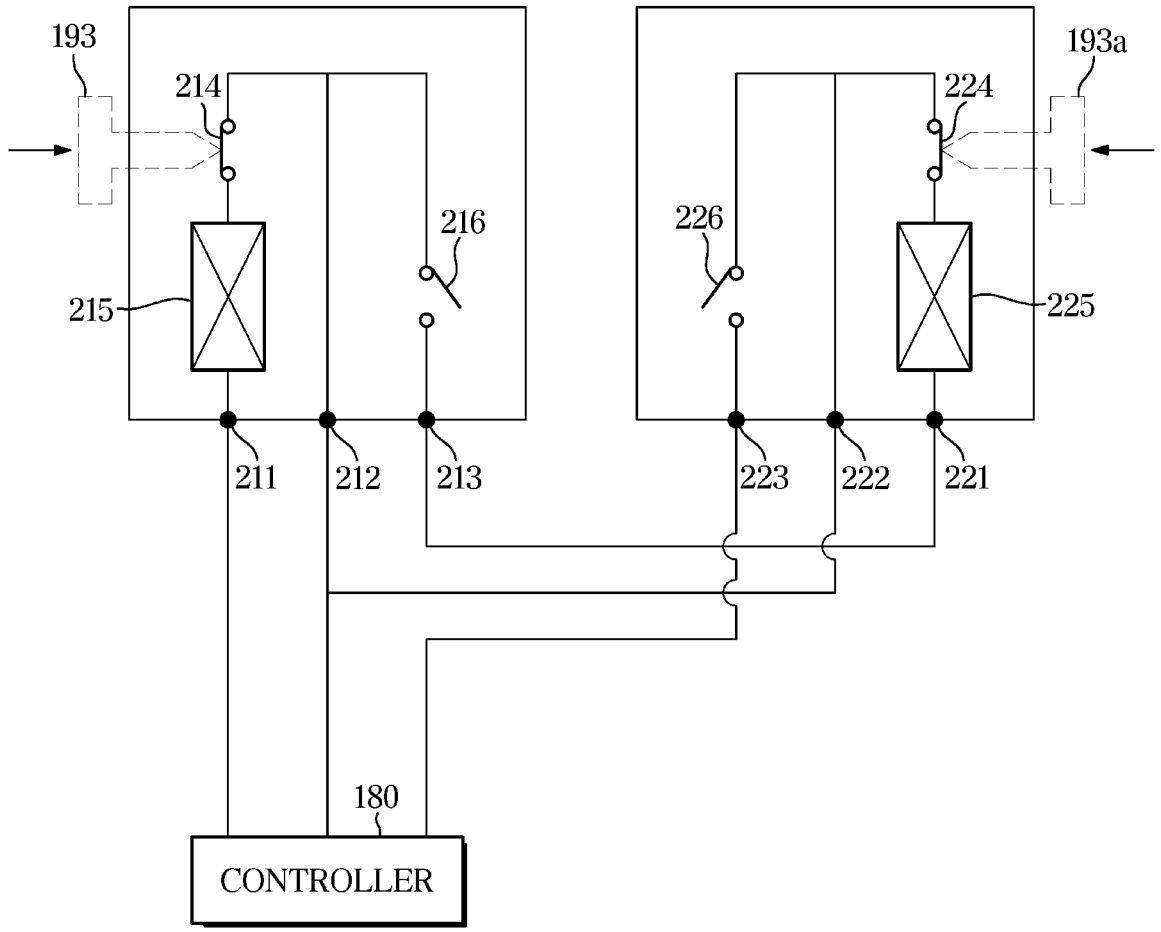
FIG. 18 illustrates an operation of the door lock due to the connection illustrated in FIG. 17.

FIG. 17 illustrates another example of the connection between the controller and the door lock included in the clothes dryer according to an embodiment. FIG. 18 illustrates an operation of the door lock due to the connection illustrated in FIG. 17.

As illustrated in FIG. 17, the dryer 100 includes the controller 180, the first door latch 210, and the second door latch 220.

The first door locking terminal 211, the first neutral terminal 212, and the first locking detection terminal 213 are provided in the first door latch 210, and the first door latch 210 includes the first closure detection switch 214, the first solenoid 215, and the first locking detection switch 216.

The second door locking terminal 221, the second neutral terminal 222, and the second locking detection terminal 223 are provided in the second door latch 220, and the second door latch 220 includes the second closure detection switch 224, the second solenoid 225, and the second locking detection switch 226.

As illustrated in FIG. 17, the elements 211, 212, 213, 214, 215, and 216 of the first door latch 210 may be disposed to be vertically symmetrical to the elements 221, 222, 223, 224, 225, and 226 of the second door latch 220.

The first door latch 210 and the second door latch 220 may be connected in series with the controller 180. The first door locking terminal 211 is connected to the controller 180, the first locking detection terminal 213 is connected to the second door locking terminal 221, and the second locking detection terminal 223 is connected to the controller 180. Also, the first neutral terminal 212 may be connected to the controller 180 together with the second neutral terminal 222.

Thus, the first solenoid 215, the first closure detection switch 214, the first locking detection switch 216, the second solenoid 225, the second closure detection switch 224, and the second locking detection switch 226 are connected in series with each other.

The controller 180 may output a door locking signal, and the door locking signal of the controller 180 may be sequentially input to the first door latch 210 and the second door latch 220.

When both the first closure detection switch 214 and the second closure detection switch 224 are closed (turned on), the first solenoid 215 and the second solenoid 225 may be sequentially driven.

On the basis of the first locking detection switch 216 and the second locking detection switch 226 being closed (turned on), the controller 180 may identify that the door 190 is locked. Since the first locking detection switch 216 and the second locking detection switch 226 are connected in series with each other, the controller 180 may identify that the door 190 is locked when both the first locking detection switch 216 and the second locking detection switch 226 are closed (turned on).

For example, the door hinge 192 may be disposed at the left side of the opening 103*a* of the front cover 103, and the lever tip 193 may be disposed at the right side end of the door 190. When the door 190 is closed, as illustrated in FIG. 18, the lever tip 193 is inserted into the first door latch 210. The user may insert a fake lever tip 193*a* into the second door latch 220 in order to close (turn on) the second closure detection switch 224. Due to the fake lever tip 193*a*, the second closure detection switch 224 may be closed (turned on) at all times, and the first closure detection switch 214 may be closed (turned on) or opened (turned off) depending on whether the door 190 is closed or opened.

Since the first door latch 210 and the second door latch 220 are connected in series with each other, the first solenoid 215 and the second solenoid 225 are either driven or not driven, depending on whether the first closure detection switch 214 is closed (turned on) or opened (turned off). When the first closure detection switch 214 is in a closed (on) state, the first solenoid 215 is driven by a primary door locking signal from the controller 180, and the second solenoid 225 is driven by a secondary door locking signal from the controller 180. When the first closure detection switch 214 is in an opened (off) state, the first solenoid 215 and the second solenoid 225 are not driven.

Figure 19:
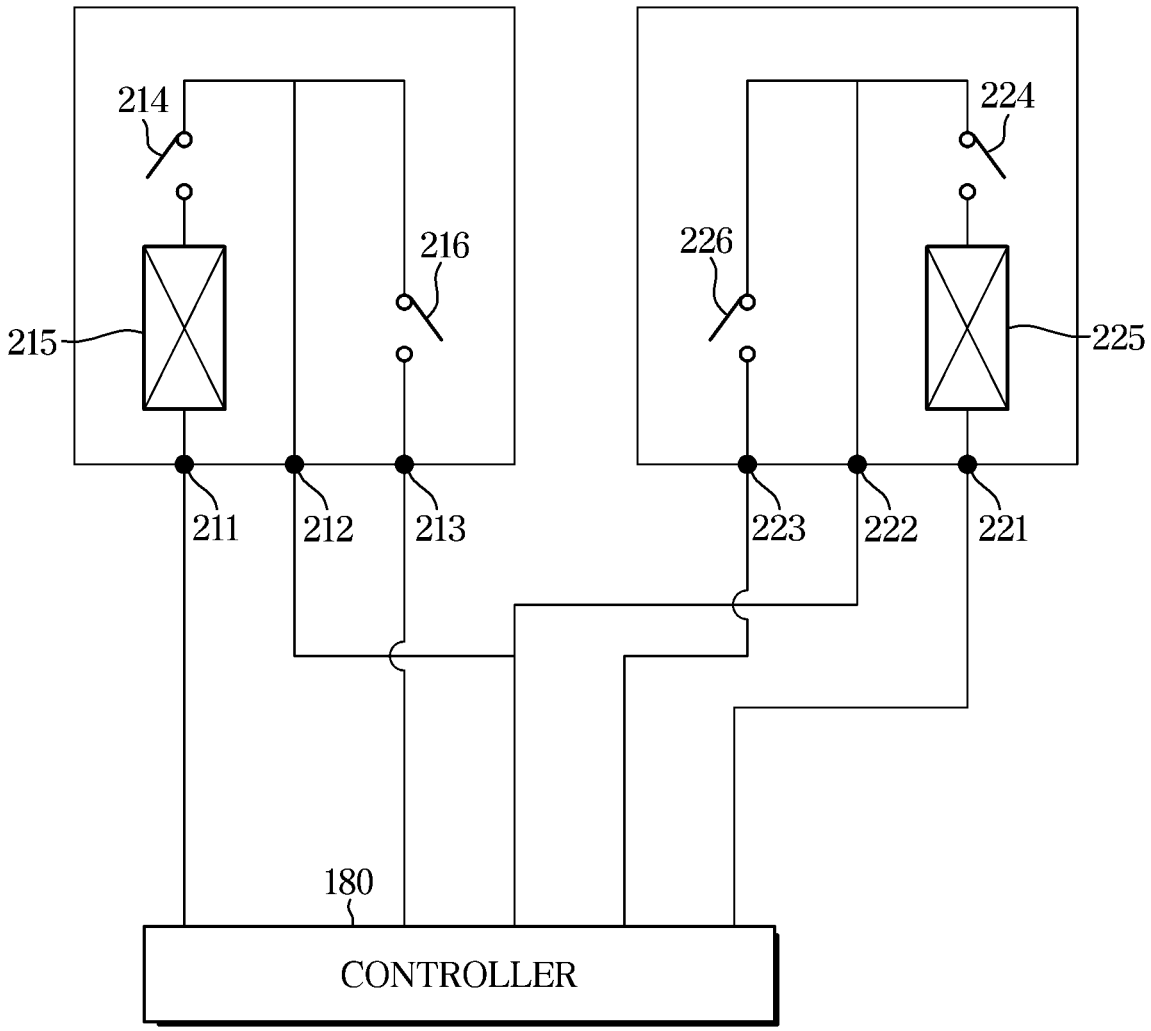
FIG. 19 illustrates another example of the connection between the controller and the door lock included in the clothes dryer according to an embodiment.

FIG. 19 illustrates another example of the connection between the controller and the door lock included in the clothes dryer according to an embodiment.

As illustrated in FIG. 19, the first closure detection switch 214, the first solenoid 215, and the first locking detection switch 216 may be disposed to be vertically symmetrical to the second closure detection switch 224, the second solenoid 225, and the second locking detection switch 226.

Each of the first door latch 210 and the second door latch 220 may be connected to the controller 180. The controller 180 may control the first door latch 210 and the second door latch 220 independently of each other. For example, the controller 180 may output a first door locking signal to the first door latch 210 and output a second door locking signal to the second door latch 220.

Also, from each of the first door latch 210 and the second door latch 220, the controller 180 may identify whether the door 190 is locked.

Figure 20:
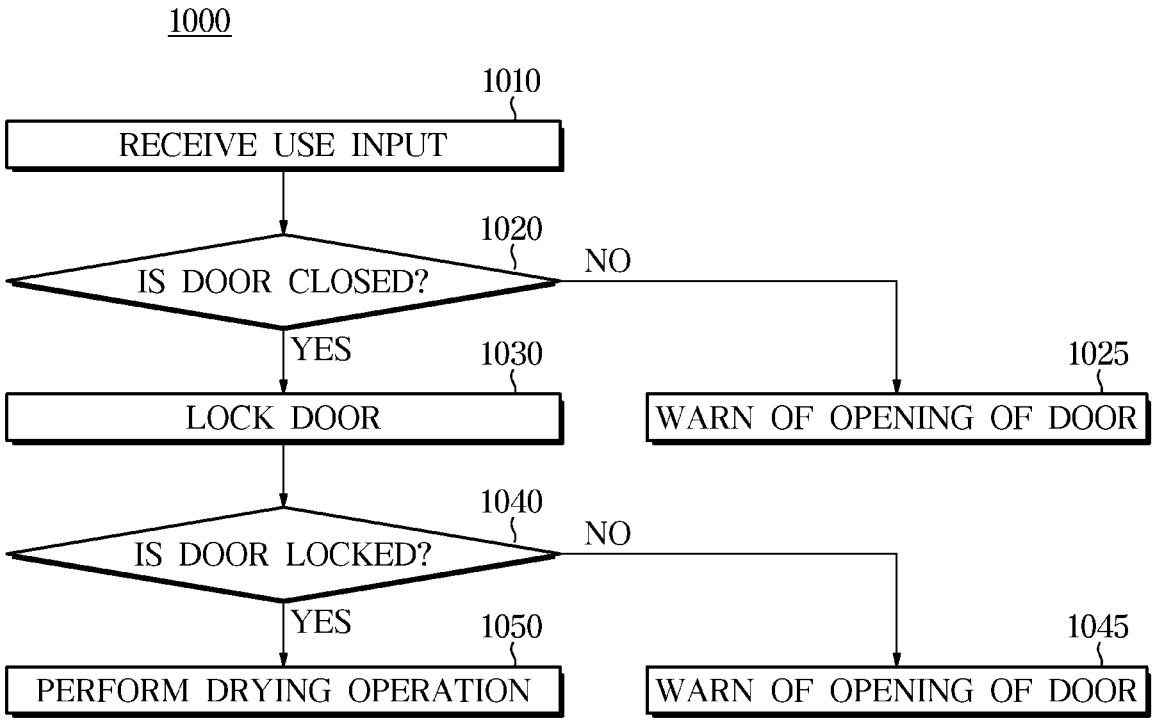
FIG. 20 illustrates an operation of the clothes dryer according to an embodiment.

FIG. 20 illustrates an operation of the clothes dryer according to an embodiment.

An operation 1000 of a dryer 100 will be described with reference to FIG. 20.

The dryer 100 receives a user input (1010).

A controller 180 may receive the user input through a user input device 110. For example, the user may select a drying course and input an operational command through the user input device 110.

The dryer 100 determines whether a door 190 is closed (1020).

When the user selects a drying course and inputs an operational command, before starting the operation, the controller 180 may determine whether the door 190 is closed. For example, the controller 180 may identify whether the door 190 is closed on the basis of whether closure of the door 190 is detected by the door closure detector 170.

When the closure of the door 190 is not detected (NO in 1020), the dryer 100 warns of the opening of the door 190 (1025).

In response to not receiving a door closure signal from the door closure detector 170, the controller 180 may display a message indicating opening of the door 190 on the display 115.

When the closure of the door 190 is detected (YES in 1020), the dryer 100 locks the door 190 (1030).

A first door latch 210 and a second door latch 220 may be connected in parallel with the controller 180, or the first door latch 210 and the second door latch 220 may be connected in series with the controller 180. Alternatively, the first door latch 210 and the second door latch 220 may be separately connected to the controller 180.

The controller 180 may output a door locking signal for locking the door 190 to the first door latch 210 and the second door latch 220.

The dryer 100 determines whether the door 190 is locked (1040).

Each of the first door latch 210 and the second door latch 220 which received the door locking signal from the controller 180 may lock the door 190 depending on whether the door 190 is closed and output the door locking signal depending on whether the door 190 is locked. The controller 180 may identify whether the door 190 is locked on the basis of whether the door locking signal is received.

When locking of the door 190 is not detected (NO in 1040), the dryer 100 warns of the opening of the door 190 (1045).

In response to not receiving a door locking signal from the door lock 200, the controller 180 may display a message indicating the opening of the door 190 on the display 115.

When the locking of the door 190 is detected (YES in 1020), the dryer 100 performs a drying operation (1050).

The controller 180 may control the drum motor 135 to rotate the drum 130 and control the fan motor 145 to rotate the fan 140. The controller 180 may control the heat pump 160 to condense water vapor from air inside the drum 130 and control the heater 155 to heat the air inside the drum 130.

Figure 21:
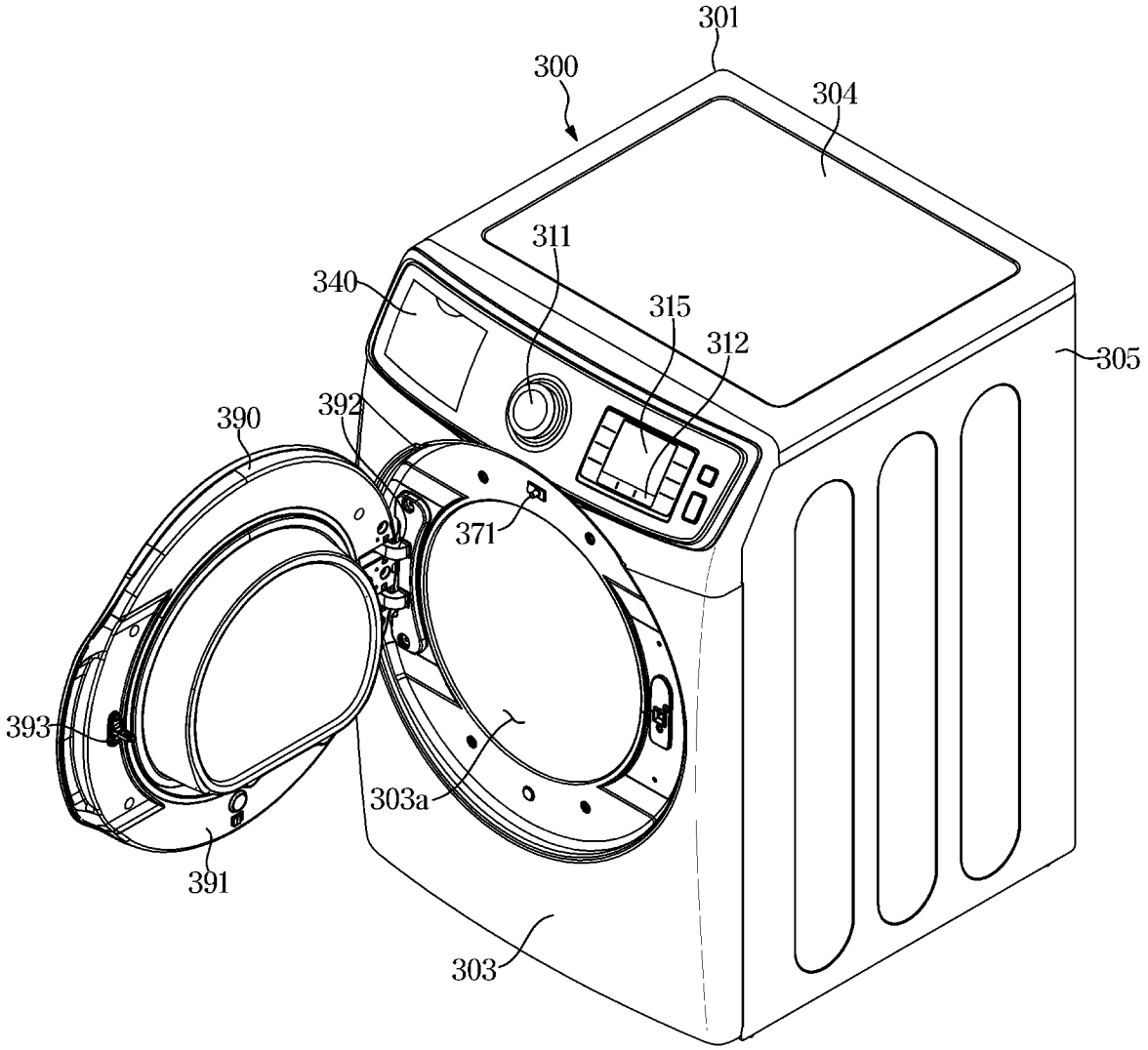
FIG. 21 illustrates an exterior of a clothes washer according to an embodiment.
Figure 22:
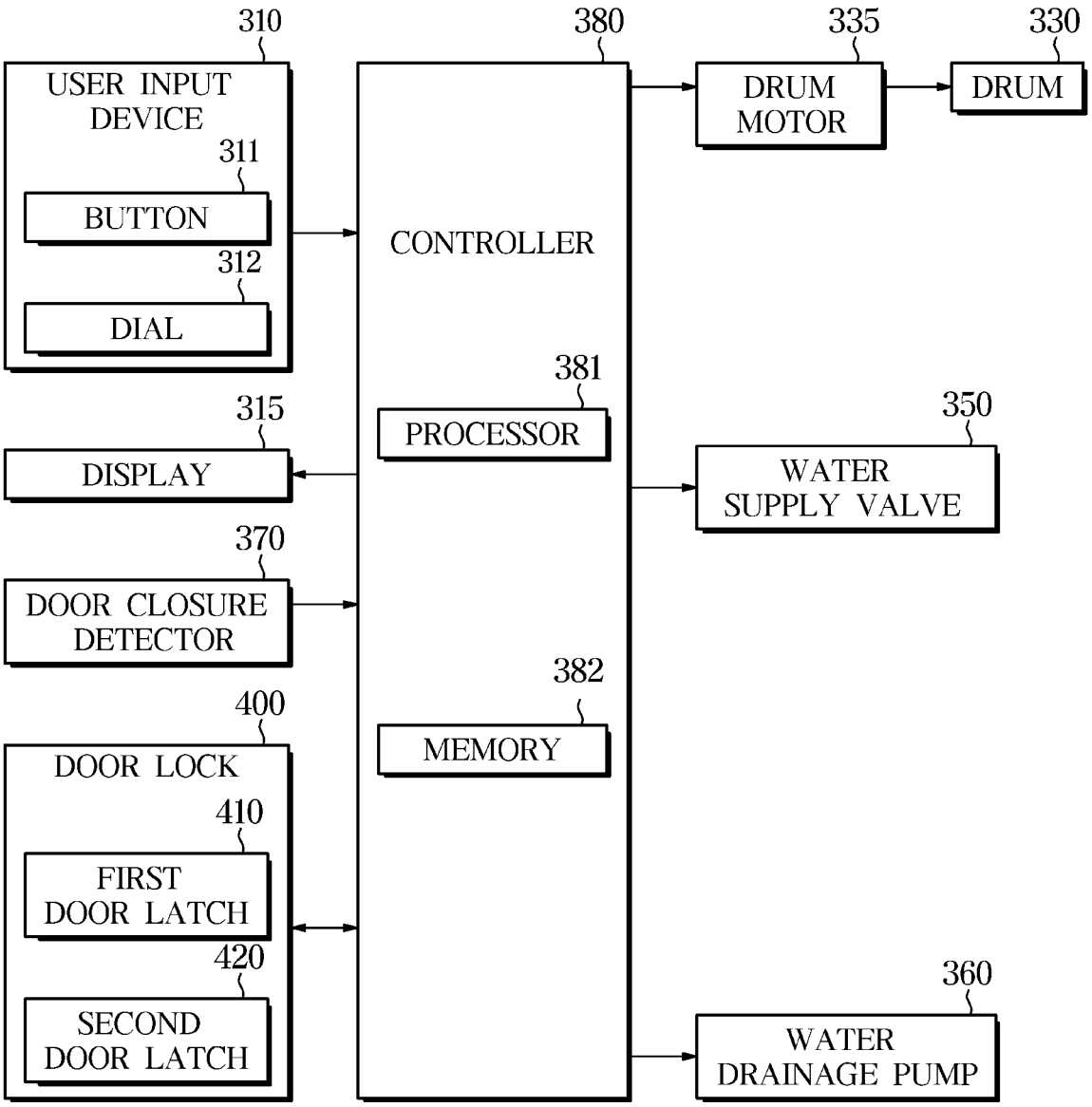
FIG. 22 illustrates a configuration of the clothes washer according to an embodiment.
Figure 23:
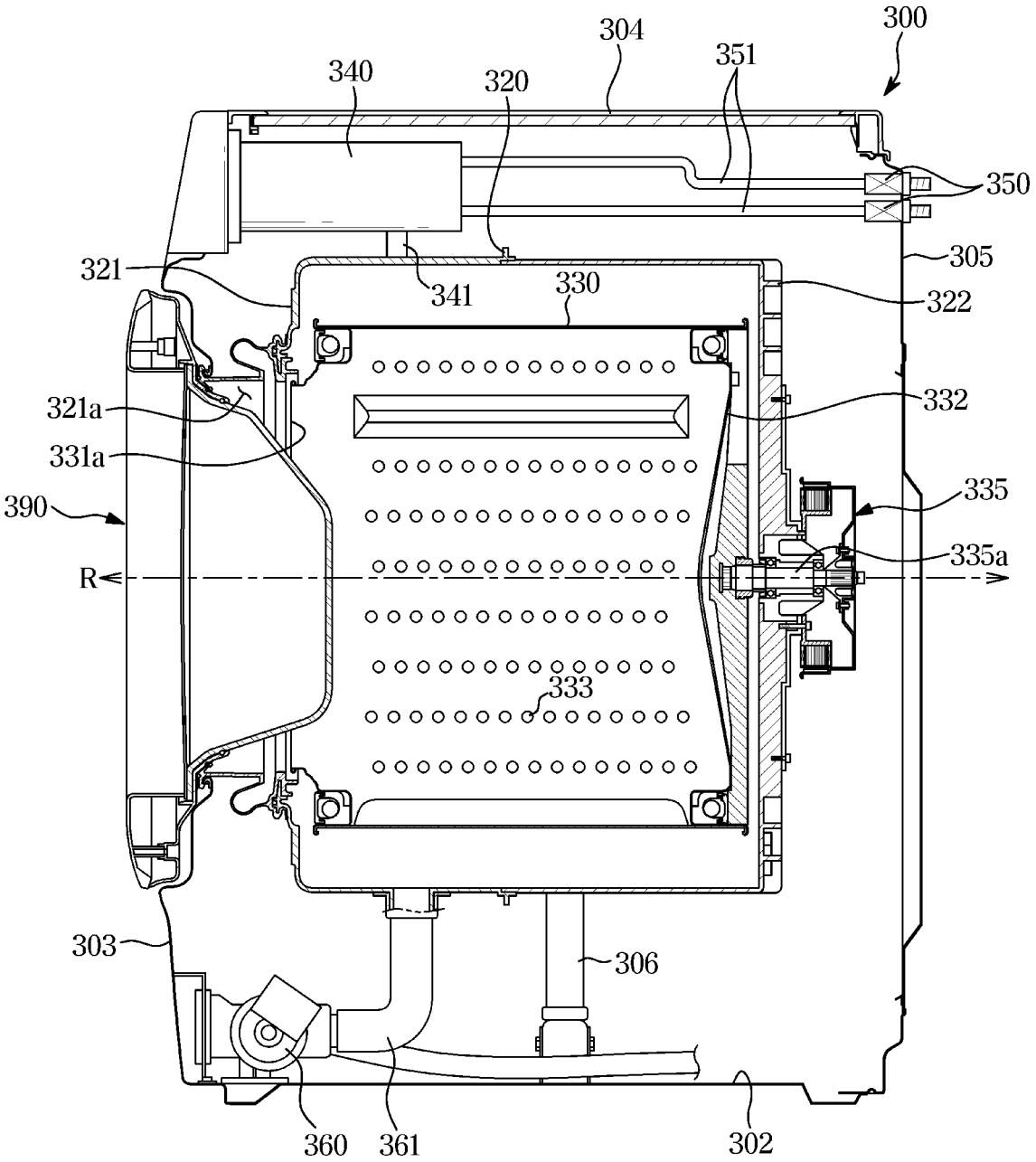
FIG. 23 illustrates a side cross-section of the clothes washer according to an embodiment.
Figure 24:
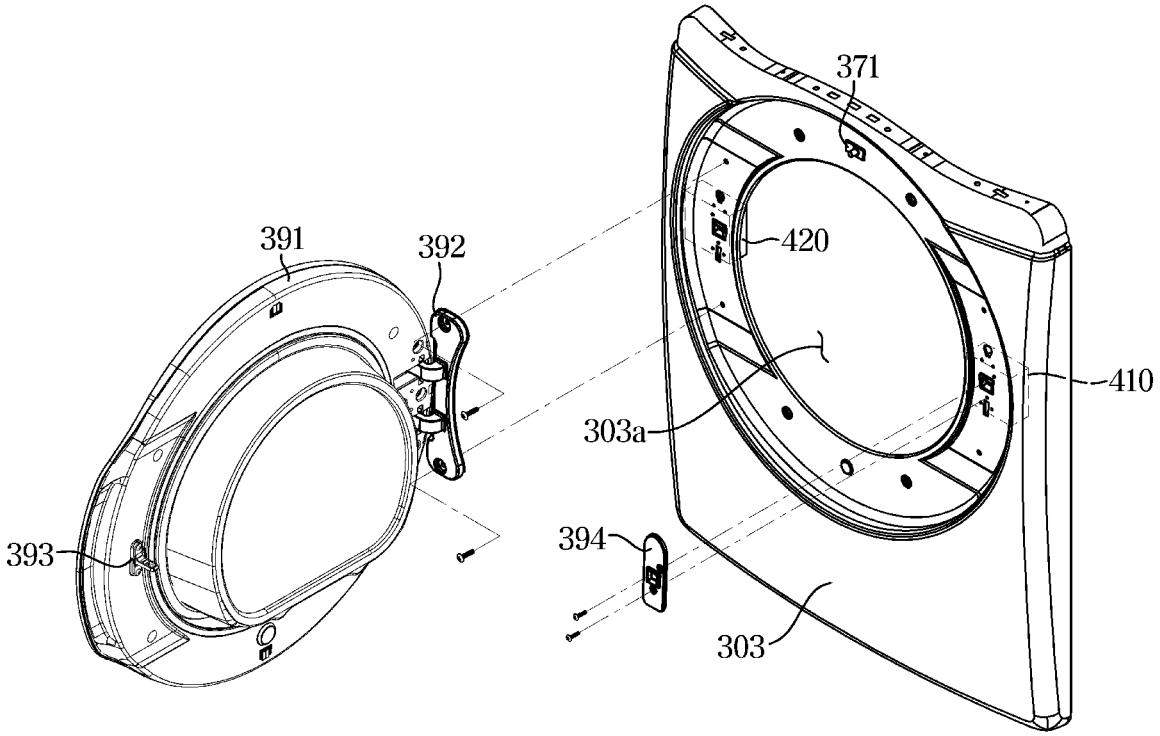
FIG. 24 illustrates coupling between a main body and a door of the clothes washer according to an embodiment.

FIG. 21 illustrates an exterior of a clothes washer according to an embodiment. FIG. 22 illustrates a configuration of the clothes washer according to an embodiment. FIG. 23 illustrates a side cross-section of the clothes washer according to an embodiment. FIG. 24 illustrates coupling between a main body and a door of the clothes washer according to an embodiment.

A washer 300 is one kind of clothes handling apparatuses.

The washer 300 refers to an apparatus which supplies water and detergent to a drum, in which an object to be washed is accommodated, and rotates the drum to wash the object to be washed. Here, the object to be washed may include any object which may be washed by a mechanical action and a chemical action. For example, the object to be washed is not limited and may be any object made of various kinds of fibers and fabrics, such as clothes and towels.

As illustrated in FIGS. 21, 22, and 23, the washer 300 includes a rectangular parallelepiped cabinet 301. Also, the washer 300 includes a user input device 310 provided inside or outside the cabinet 301, a display 315, a water tank 320, a drum 330, a drum motor 335, a detergent compartment 340, a water supply valve 350, a water drainage pump 360, a door closure detector 370, a door lock 400, and a controller 380.

The cabinet 301 may include a base plate 302, a front cover 303, a top cover 304, and a side-rear cover 305.

The user input device 310 and the display 315 for control of the washer 300 may be disposed at an upper end of the front cover 303.

The user input device 310 includes a dial 311 and a button 312.

For example, the washer 300 may include different washing courses for washing different objects to be washed, and the user may select any one of a plurality of washing courses by rotating the dial 311.

The washer 300 may include a power button for permitting or interrupting power supplied from an external power supply and an operational button for starting or stopping a washing operation of the washer 300.

The user input device 310 may receive a control command related to the washer 300 from the user and output an electrical signal corresponding to the received control command to the controller 380.

The display 315 may display an operational state of the washer 300 and a control command from the user. For example, the display 315 may display a washing course selected by the user and display the time remaining until the end of washing during operation of the washer 300.

The display 315 may also employ a TSP configured to receive a control command from a user and display operational information corresponding to the received control command.

In this way, the display 315 may receive a control signal related to the display from the controller 380 and display an image corresponding to the received control signal.

The washer 300 includes the water tank 320 configured to accommodate water for washing. The water tank 320 may be installed to be able to vibrate in the cabinet 301 due to a damper 306. The damper 306 reduces the size of vibration transmitted to the cabinet 301 from the water tank 320 when the water tank 320 vibrates.

The water tank 320 may be formed in a cylindrical shape. The water tank 320 may include a front portion 321 having an inlet 321*a* formed therein to allow an object to be washed to be put in the drum 330 and a rear portion 322 through which a rotating shaft 335*a* of the drum motor 335 passes.

The washer 300 includes the drum 330 configured to accommodate an object to be washed and wash the object to be washed. The drum 330 may be rotatably installed in the water tank 320.

The drum 330 may be formed in a cylindrical shape whose center of rotation is formed in the front-rear, horizontal direction. A front panel 331 having an opening 331*a* formed therein to allow an object to be washed to be put in the drum 330 may be disposed at a front surface of the drum 330. Also, a rear surface of the drum 330 may be closed by a rear panel 332 connected to the rotating shaft 335*a* of the drum motor 335.

The drum 330 may have a through-hole 333 formed therein to allow introduction of the water stored in the water tank 320 into the drum 330.

The drum 330 may receive a rotary force from the drum motor 335 and rotate.

The drum motor 335 is installed behind the water tank 320 and is connected to the drum 330 through the rotating shaft 335*a* passing through the water tank 320. The drum motor 335 may provide a rotary force to the drum 330 through the rotating shaft 335*a*.

The detergent compartment 340 configured to store a detergent may be provided at an upper side of the water tank 320. The detergent compartment 340 may be connected to the water tank 320 through a connection tube 341. The water and the detergent may be supplied to the water tank 320 through the connection tube 341.

A water supply tube 351 configured to connect an external water supply and the detergent compartment 340 to each other may be provided at the upper side of the water tank 320. A water supply valve 350 configured to close or open the water supply tube 351 may be installed in the water supply tube 351.

In response to opening of the water supply valve 350, the water moves to the detergent compartment 340 through the water supply tube 351 and is mixed with the detergent in the detergent compartment 340. The mixture of the water and the detergent may be supplied to the water tank 320 through the connection tube 341.

A water drainage tube 361 configured to guide the water in the water tank 320 to the outside may be provided at a lower side of the water tank 320. The water drainage pump 360 configured to pump the water out of the water tank 320 may be installed in the water drainage tube 361.

Due to the operation of the water drainage pump 360, the water in the water tank 320 may be discharged to the outside of the washer 300.

As illustrated in FIG. 24, an opening 303*a* formed in a substantially circular shape when viewed from the front is provided in the front cover 303 of the cabinet 301.

The opening 303*a* is opened or closed by a door 390 rotatably installed at the cabinet 301. The door 390 includes a door base 391, a door hinge 392, and a lever tip 393.

The door base 391, the door hinge 392, and the lever tip 393 may be identical to the door base 191, the door hinge 192, and the lever tip 193 of the dryer 100, respectively.

Specifically, the door hinge 392 may be installed at a left side of the opening 303*a* or installed at a right side of the opening 303*a*. The door 390 may be rotatably fixed to the left side of the opening 303*a* or rotatably fixed to the right side of the opening 303*a*, depending on a position at which the door hinge 392 is installed.

The lever tip 393 may be installed at the opposite side of the door hinge 392 on the door base 391. When the door hinge 392 is disposed at the left side end of the door base 391, the lever tip 393 may be disposed at the right side end of the door base 391 and be inserted into a hole in the right side of the opening 303*a* when the door 390 is closed. Also, when the door hinge 392 is disposed at the right side end of the door base 391, the lever tip 393 may be disposed at the left side end of the door base 391 and be inserted into a hole in the left side of the opening 303*a* when the door 390 is closed.

The door closure detector 370 may detect a closed state of the door 390 and an opened state of the door 390. For example, the door closure detector 370 may include a push switch 371 disposed in the vicinity of the opening 303*a* of the cabinet 301. The push switch 371 may be identical to the push switch 171 of the dryer 100.

The door lock 400 may include a first door latch 410 and a second door latch 420 which are capable of locking the door 390. The first door latch 410 and the second door latch 420 may be identical to the first door latch 210 and the second door latch 220 of the dryer 100.

Specifically, the first door latch 410 and the second door latch 420 may be provided at an inner side of the front cover 303 of the cabinet 301. The first door latch 410 may be installed at the right side of the opening 303*a* when the cabinet 301 is viewed from the front. The second door latch 420 may be installed at the left side of the opening 303*a* when the cabinet 301 is viewed from the front.

When the door 390 is rotatably fixed to the left side of the opening 303*a*, the door 390 may be closed by rotating rightward from the left side, and the first door latch 410 provided at the right side of the opening 303*a* may fix the lever tip 393 of the door 390.

When the door 390 is rotatably fixed to the right side of the opening 303*a*, the door 390 may be closed by rotating leftward from the right side, and the second door latch 420 provided at the left side of the opening 303*a* may fix the lever tip 393 of the door 390.

The first door latch 410 and the second door latch 420 may be configured to be symmetrical to each other. The first door latch 410 may include a first closure detection switch, a first solenoid, and a first locking detection switch, and the second door latch 420 may include a second closure detection switch, a second solenoid, and a second locking detection switch. The first closure detection switch, the first solenoid, and the first locking detection switch may be disposed to be vertically symmetrical to the second closure detection switch, the second solenoid, and the second locking detection switch.

The controller 380 may include a memory 382 configured to store a program and data for controlling the operation of the washer 300 and a processor 381 configured to generate a control signal for controlling the operation of the washer 300 according to the program and data stored in the memory 382. The memory 382 and the processor 381 may be implemented with separate chips or implemented with a single chip. Also, the controller 380 may include a plurality of memories or a plurality of processors.

For example, the controller 380 may perform the operation 1000 of FIG. 20 which has been described above. Specifically, the controller 380 may identify that the door 390 is closed and lock the door 390.

In accordance with one aspect of the present disclosure, it is possible to provide a clothes handling apparatus that allows a user to easily change a door opening direction.

In accordance with one aspect of the present disclosure, it is possible to provide a clothes handling apparatus that allows a user to change a door opening direction without removing a front panel of a main body.

In accordance with one aspect of the present disclosure, it is possible to provide a clothes handling apparatus that allows a door to be locked even when a user changes an opening direction of the door.

In accordance with one aspect of the present disclosure, it is possible to provide a clothes handling apparatus that includes a pair of door locking devices installed at both sides of an opening for putting clothes in a drum.

In accordance with one aspect of the present disclosure, it is possible to provide a clothes handling apparatus in which a pair of door locking devices are formed to be symmetrical to each other.

Meanwhile, a computer-readable recording medium may include all type of recording media in which computer-readable instructions are stored. Examples of the computer-readable recording medium may include a ROM, a RAM, a magnetic tape, a magnetic disk, a flash memory, and an optical data storage.

The embodiments disclosed herein have been described above with reference to the accompanying drawings. Those of ordinary skill in the art to which the disclosed embodiments pertain should understand that the present disclosure may be practiced in forms different from the disclosed embodiments even without changing the technical idea or essential features of the disclosed embodiments. The disclosed embodiments are merely illustrative and should not be interpreted as limiting.

What is claimed is:

1. A clothes handling apparatus comprising:

a cabinet having an opening formed in a front surface of the cabinet;

a first door latch installed at a right side of the opening;

a second door latch installed at a left side of the opening; and a door to open or close the opening, the door including:

a door base, a door hinge coupled to a first side of the door base, and a lever tip disposed at a second side, opposite to the first side, of the door base, wherein the first door latch and the second door latch each include:

a closure detection switch to detect closure of the door, a solenoid to lock the door on the basis of detection of the closure of the door by the closure detection switch, a locking detection switch to detect locking of the door, a catch cap configured to be caught by the lever tip, a door slider configured to move from a first position to a second position due to the door being closed and to turn on the closure detection switch at the second position, and a locking slider configured to move from a third position to a fourth position due to operation of the solenoid, and to fix the catch cap and turn on the locking detection switch at the fourth position.

2. The clothes handling apparatus of claim 1, wherein the lever tip is:

fixable by the first door latch when the door hinge is removably installed on the front surface of the cabinet at the left side of the opening and the lever tip becomes inserted into the first door latch, to thereby lock the door; and fixable by the second door latch when the door hinge is removably installed on the front surface of the cabinet at the right side of the opening and the lever tip becomes inserted into the second door latch, to thereby lock the door.

3. The clothes handling apparatus of claim 1, further comprising:

a controller configured to:

when the door hinge is removably installed on the front surface of the cabinet at the left side of the opening, the lever tip becomes inserted into the first door latch, and the closure detection switch is turned on, control the first door latch to fix the lever tip to thereby lock the door, and when the door hinge is removably installed on the front surface of the cabinet at the right side of the opening, the lever tip becomes inserted into the second door latch, and the closure detection switch is turned on, control the second door latch to fix the lever tip to thereby lock the door.

4. The clothes handling apparatus of claim 3, wherein the first door latch and the second door latch are connected in parallel with the controller.

5. The clothes handling apparatus of claim 3, wherein the first door latch and the second door latch are connected in series with the controller.

6. The clothes handling apparatus of claim 1, wherein the first door latch and the second door latch are formed to be symmetrical to each other.

7. The clothes handling apparatus of claim 1, wherein the closure detection switch, a locking slider, the solenoid, and the locking detection switch of the first door latch are disposed to be bilaterally symmetrical to the closure detection switch, a locking slider, the solenoid, and the locking detection switch of the second door latch.

8. The clothes handling apparatus of claim 1, wherein, in each of the first door latch and the second door latch:

the closure detection switch and the solenoid are connected in series with each other, and the locking detection switch is connected in parallel with the closure detection switch and the solenoid.

9. The clothes handling apparatus of claim 8, further comprising:

a controller configured to output a door locking signal to the first door latch and the second door latch, wherein the solenoid locks the door in response to the door locking signal while the closure detection switch is closed.

10. The clothes handling apparatus of claim 9, wherein:

the locking detection switch is closed by the solenoid; and the controller identifies whether the door is locked on the basis of whether the locking detection switch is closed.

11. The clothes handling apparatus of claim 1, wherein the cabinet has a front cover in which the opening is formed, and the front surface of the cabinet on which the door hinge is removably installable is a front surface of the front cover.

12. The clothes handling apparatus of claim 11, wherein the door hinge is configured to be removably installable on the front cover via screws.

13. The clothes handling apparatus of claim 11, further comprising:

screws, wherein the door hinge is removably installable on the front cover via the screws.

14. A clothes handling apparatus comprising:

a cabinet having an opening formed in a front surface of the cabinet;

a door lock including a first door latch installed at a right side of the opening and a second door latch installed at a left side of the opening;

a door installable at the left side of the opening or the right side of the opening so as to be rotatable to open or close the opening, and so that, when the door is installed at the left side of the opening, the door is lockable by the first door latch, and when the door is installed at the right side of the opening, the door is lockable by the second door latch; and a lever tip on the door, wherein the first door latch and the second door latch each include:

a closure detection switch provided to detect closure of the door, a solenoid provided to lock the door on the basis of detection of the closure of the door by the closure detection switch, a locking detection switch provided to detect locking of the door, a catch cap configured to be caught by the lever tip, a door slider configured to move from a first position to a second position due to the door being closed and to turn on the closure detection switch at the second position, and a locking slider configured to move from a third position to a fourth position due to operation of the solenoid, and to fix the catch cap and turn on the locking detection switch at the fourth position.

* * * * *